US012742250B2

(12) United States Patent
Zhao et al.

(10) Patent No.: US 12,742,250 B2
(45) Date of Patent: Sep. 22, 2026

(54) HIGH-SELECTIVITY HYDROPHILIC ELECTRODE FOR EXTRACTING LITHIUM AND PREPARATION METHOD THEREOF

(71) Applicant: CENTRAL SOUTH UNIVERSITY, Changsha (CN)

(72) Inventors: Zhongwei Zhao, Changsha (CN); Lihua He, Changsha (CN); Wenhua Xu, Changsha (CN)

(73) Assignee: CENTRAL SOUTH UNIVERSITY, Changsha (CN)

( * ) Notice: Subject to any disclaimer, the term of this patent is extended or adjusted under 35 U.S.C. 154(b) by 347 days.

(21) Appl. No.: 17/783,210

(22) PCT Filed: Apr. 21, 2022

(86) PCT No.: PCT/CN2022/088085

§ 371 (c)(1),
(2) Date: Jun. 7, 2022

(87) PCT Pub. No.: WO2022/242406

PCT Pub. Date: Nov. 24, 2022

(65) Prior Publication Data

US 2024/0167182 A1 May 23, 2024

(30) Foreign Application Priority Data

May 21, 2021 (CN) ..... 202110555919.7
May 21, 2021 (CN) ..... 202110555920.X
May 21, 2021 (CN) ..... 202110555923.3

(51) Int. Cl.
*C25C 7/02* (2006.01)
*C25C 1/02* (2006.01)

(52) U.S. Cl.
CPC . *C25C 7/02* (2013.01); *C25C 1/02* (2013.01)

(58) Field of Classification Search
None
See application file for complete search history.

(56) References Cited

PUBLICATIONS

Kim et al.; An Electrochemical Cell for Selective Lithium Capture from Seawater; Environmental Science & Technology; 2015, 49, 9415-9422.*

* cited by examiner

*Primary Examiner* — Michael P. Rodriguez
(74) *Attorney, Agent, or Firm* — LANWAY IPR SERVICES; Chun-Ming Shih

(57) ABSTRACT

The present disclosure relates to a high-selectivity hydrophilic electrode for electrochemically extracting lithium and a preparation method thereof. The preparation method includes the step of carrying out surface coating modification on an electrode active material by using polydopamine. The interception of impurity ions is achieved by utilizing the advantages, which polydopamine has, of preferentially accumulating and transporting lithium ions, thereby improving the selectivity of the electrode active material on lithium. In the pulping process of an electrode adsorption material, a hydroxyl-containing polar hydrophilic organic polymer compound is introduced to perform blending modification, thereby improving the hydrophilicity of a binder polyvinylidene fluoride (PVDF). In addition, pore formation via inorganic salts is combined with a drying mode of "low temperature-high temperature" so that the "porous-microcrack" morphology is formed on the electrode, thereby improving the mass transfer effect of the solution inside the electrode. The preparation method of the electrode disclosed by the present disclosure has the characteristics of simplicity, practicability, environmental friendliness, low cost and the like, and is easy for industrial production.

10 Claims, 7 Drawing Sheets

HIGH-SELECTIVITY HYDROPHILIC ELECTRODE FOR EXTRACTING LITHIUM AND PREPARATION METHOD THEREOF

TECHNICAL FIELD

The present disclosure belongs to the field of extracting lithium from a salt lake, and particularly relates to a high-selectivity electrode for extracting lithium from a solution by using an electrochemical de-intercalation method, and a preparation method thereof.

BACKGROUND

In recent years, with the rapid development of new energy vehicles and chemical energy storage, there is a sharp increase on the demands of lithium. Extraction of lithium from a salt lake has drawn more and more attentions because there are lithium resources (accounting for about 70% of lithium resource storage amount all over the world) which have a huge storage amounts in salt lake brine.

The salt lake brine contains low-concentration lithium and high-concentration impurity elements such as sodium, magnesium, potassium and boron, which causes a fact that the lithium resource in the salt lake is difficult to effectively develop and utilize. As for the problem of extracting lithium from the salt lake, the existing technology discloses isolation and enrichment of lithium from a lithium-containing solution or salt lake brine (Chinese Patents 201110185128.6, 201010555927.3 and 201010552141.6, and U.S. Pat. No. 9,062,385B2). This method mainly includes the following processes: 1) an electrodialysis device is divided into two polar chambers via an anion exchange membrane: a lithium salt chamber and a brine chamber, salt lake brine is injected into the brine chamber, an impurity-free support electrolyte solution is injected into the lithium salt chamber; 2) an electrode coated with an ion sieve is placed into the brine chamber to serve as a cathode; an electrode coated with a lithium-intercalated ion sieve is placed into the lithium salt chamber to serve as an anode; 3) under the drive of an external potential, $Li^+$ in the brine of the brine chamber is intercalated into the ion sieve to form the lithium-intercalated ion sieve, the $Li^+$ is de-intercalated by the lithium-intercalated ion sieve into the support electrolyte so as to be recovered to the ion sieve. This method has good selectivity and enrichment ability on lithium. However, in the actual process of production, since salt lake brine itself has the characteristics of high salinity and high viscosity so that the mass transfer of the brine inside the electrode is extremely difficult so as to cause low current density and low lithium extraction rate. When the above patent technology is adopted to extract lithium, the salt lake brine is treated by utilizing an electrochemical de-intercalation system constructed by a $LiFePO_4/FePO_4$ electrode pair, with current density maintained to be 2-4 $A/m^2$. Chinese patent CN 107201452 B discloses a method for extracting lithium from a lithium-containing solution based on a $LiMn_2O_4$ electrode material, with an average current density being only 3-6 $A/m^2$. In a device for extracting lithium from a continuous flow control asymmetric lithium ion capacitor disclosed by Chinese patent CN 108560019 B, a lithium ion positive electrode material of lithium manganate, lithium iron phosphate, lithium nickel molybdenum manganate and $LiA_xB_yC_{(1-x-y)}O_z$ ternary oxides is used as an intercalation material of lithium, and the current density claimed in claims is only 5 $A/m^2$. In addition, in an "auto-driven" electrochemical lithium extraction method based on a "rocking chair" type structural electrode system disclosed by Chinese patent (patent No. 201911082936.2), its average current density does not exceed 4 $A/m^2$. The lower the current density is, the lower the capacity per unit electrode area is, the higher the corresponding equipment investment is. In addition, in the traditional process of extracting lithium via an electrochemical de-intercalation method, the cathode is easily polarized in the lithium extraction process due to high concentration of impurity ions in the brine and poor infiltration property of electrodes, leading to a fact that impurity ions are intercalated into the electrode material. Intercalation of the impurity ions not only reduces the extraction efficiency of lithium but also has potential harm to the cyclic performance of the electrode material. Therefore, it is urgent to develop a high-current-density high-selectivity hydrophilic electrode for extracting lithium.

SUMMARY

To solve the problems that an electrode for an electrochemical deintercalation method has low current density, low lithium selectivity in brine and poor infiltration property, the present disclosure aims to provide an electrode with high lithium extraction efficiency, good selectivity and strong hydrophilicity and a preparation technology thereof. Efficient selective isolation and enrichment of lithium can be achieved by using the electrode of the present disclosure and adopting an electrochemical method. Furthermore, the electrode is simple in preparation process and easy for industrial production.

In order to achieve the above objective, the technical solution adopted by the present disclosure is as follows: surface modification is carried out on an electrode active material by using a dopamine solution so that a coating layer is formed on the surface of the active material, this coating layer has the effects of preferential agglomeration and transmission of lithium ions, so as to intercept impurity ions and improve the selectivity of the electrode active material on lithium. In addition, in the preparation process of an electrode plate, a polyvinylidene fluoride (PVDF) binder is subjected to blending modification by adding a hydroxyl-containing polymer compound, thereby improving the hydrophilicity of the electrode. Meanwhile, in the pulping process, a solution mass transfer channel with "porous-microcracks" is formed on the surface and the interior of the electrode by adding a soluble solid salt as a pore forming agent and carbon fibers as a structure reinforcing agent, and adopting a drying method of "first low temperature and then high temperature", which improves the permeability of the solution in the electrode, so as to achieve the purpose of improving the current density.

Specifically, the present disclosure provides a preparation method of a high-selectivity hydrophilic electrode for extracting lithium, comprising the following steps:

(1) putting an electrode active material into a 0.5-5 g/L polydopamine salt solution in a solid-to-liquid mass ratio of 1:5, adjusting the pH value of the solution to 8-9.5, stirring and reacting for 10-12 hours at room temperature; after the reaction is ended, filtering and washing, and drying filter residues at the temperature of 80-120° C. to obtain a polydopamine modified electrode powder material;

(2) adding a polymer compound and a PVDF binder into an N-methyl pyrrolidone solvent, mechanically stirring in vacuum until the above materials are completely dissolved, so as to obtain a mixed glue solution;

(3) adding the modified electrode powder material obtained in step (1), a conductive agent acetylene black, a pore forming agent and short-carbon fibers into the mixed glue solution obtained in step (2) in a proportion, and then mechanically stirring for 4-8 hours in vacuum to obtain an electrode slurry; and (4) coating the electrode slurry obtained in step (3) on a current collector, and then performing segmented drying and water leaching treatment on the coated electrode in turn, so as to obtain a finished product electrode.

Further, the electrode active material is a lithium ion electrode material,

Further, the electrode active material is one of $LiFePO_4$, $LiMn_2O_4$, $LiNi_xCo_yMn_{(1-x-y)}O_2$ ($0<x$, $y<1$, $0<x+y<1$) and doped derivatives thereof.

Specifically, the above electrode active material has the characteristics of lithium ion transport migration channels, redox reaction sites, a chemically stable lattice structure and the like, and should have a stable electrochemical working window in an aqueous solution. Lithium ions can be selectively intercalated/de-intercalated in the material by controlling the redox potential of the electrode.

Since the polydopamine coating layer not only has good hydrophilicity but also takes the effects of preferentially accumulating and transporting lithium ions, impurity ions are intercepted due to larger energy required for penetrating through this coating layer. Therefore, coating the polydopamine on the surface of the active material can achieve initial isolation of lithium and other impurity ions in the salt lake brine, and then the high-selective extraction of the lithium ions under high current density can be achieved by utilizing the selectivity of the active material itself.

In the polydopamine modification process of the active material, when being in contact with air under the weakly alkaline condition, dopamine can be converged on the surfaces of particles and a polydopamine coating layer is formed. Under the acidic condition, it is needed to add a certain catalyst, and the dissolution and denaturation of the active material are easily caused under the strong alkaline condition. Therefore, the surface coating of the polydopamine via air oxidation under the weakly alkaline environment is simple and feasible.

Further, the polymer compound is preferably a mixture of one or more of polyethylene glycol, polyvinyl alcohol, chitosan and polypropylene glycol.

Specifically, the electrode for extracting lithium is prepared by adhering electrode active material particles with a binder, and then coating and drying. The property of a glue solution is strongly relevant to the property of the final electrode. Since the lithium extraction process is carried out in an aqueous solution system, the more hydrophilic the electrode is, the more favorable the lithium extraction process is. However, the hydrophilicity of the binder in the glue solution is inherited to the final electrode, so the hydrophilicity of the electrode can be improved through hydrophilic modification of the binder in the glue solution. Therefore, by adding the hydroxyl-containing polymer compound during the pulping, the blending modification of the PVDF binder can be achieved, the hydrophilicity of PVDF is improved, and then the hydrophilicity of the whole electrode is improved, and the wettability between the solution and the interface of the electrode active material is strengthened, thereby facilitating the improvement of the electrochemical performance of the electrode.

Specifically, the pore forming agent is a mixture of one or more of soluble inorganic salt solids such as NaCl, KCl, $Na_2SO_4$, $K_2SO_4$, $Na_2CO_3$ and $K_2CO_3$.

It should be understood that, to improve the permeability of the whole electrode plate, strengthen the mass transfer effect of the solution inside the electrode and reduce the polarization of the electrochemical lithium extraction process, it is one of effective ways to enlarge a solution transportation path by forming pores. A certain proportion of soluble inorganic salts are added in the preparation process of the electrode slurry, when the inorganic salt particles can be evenly dispersed onto the surface and the interior of the electrode after the electrode plate is dried, the whole electrode shows a porous morphology through water leaching treatment because these inorganic salts are soluble in the aqueous solution. These porous structures provide channels for diffusion and mass transfer of the solution inside the electrode, thereby effectively improving the mass transfer of the solution inside the electrode.

In addition, to make the electrode have good wettability, it is required for particle size distribution of an inorganic salt pore forming agent to satisfy certain conditions. On the one hand, an overlarge particle size easily causes too high electrode porosity so that the strength of the electrode plate is reduced; on the other hand, too small particle size easily results in a fact that closed holes are formed inside the electrode plate so as not to serve as a solution mass transfer channel. Specifically, the particle size distribution of the pore forming agent is preferably as follows: 50-100 meshes of the pore forming agent accounts for 20-30% of the weight of total salts, 100-200 meshes of the pore forming agent accounts for 20-30% of the weight of the total salts, and more than 200 meshes of the pore forming agent accounts for 40-20% of the weight of the total salts.

Further, the particle size of the short-carbon fiber is 0.5-3 mm.

Specifically, the addition of the pore forming agent can weaken the strength of the final electrode, while addition of a certain amount of carbon fibers can exert the purpose of strengthening the structure strength of the electrode coating layer. On the one hand, the materials of different areas of the coating layer are interconnected in a bridging manner through addition of the short-carbon fibers, so as to reduce the falling off of the materials; on the other hand, the short-carbon fibers can also take the conductive effect. Considering the thickness of the electrode plate and prevention of clotting and winding of the carbon fibers in the preparation process of slurry, the length of the short-carbon fiber needs to be defined.

Further, the addition amounts of the polymer compound, the PVDF, the acetylene black, the pore forming agent, the short-carbon fibers and the N-methyl pyrrolidone in the slurry are 0.5-5%, 8-15%, 10-15%, 10-30%, 1-5% and 150-200% of the weight of the electrode powder, respectively.

Specifically, on the premise of ensuring that the finished electrode has good hydrophilicity, conductivity, permeability and lithium extraction performance, on the one hand, the hydrophilicity, conductivity and structure strength required by the electrode materials cannot be well ensured due to too small addition amounts of polymer compounds, conductive agents, short-carbon fibers, pore forming agents and the like; however, excessive addition easily causes the proportion of the electrode active material to be too low, which is not beneficial to exertion of electrochemical performance. The too small amount of N-methyl pyrrolidone serving as a solvent in the preparation process of slurry and a controlling agent for slurry flowability, one the one hand, can cause insufficient dissolution of polymer compounds and PVDF, and on the other hand, leads to too high slurry viscosity so as not to facilitate the slurry to be coated on the current collector; excessive addition can result in waste of raw materials and increase in processing costs. Especially, excessive addition of N-methyl pyrrolidone (NMP) can lead to reduction in slurry viscosity so that the slurry is difficult to coat while the electrode active material is easy to settle and layer, and then result in the imbalanced proportion of the electrode material and the sharply reduced electrochemical performance of the electrode.

Further, the current collector is one of a carbon fiber cloth, a carbon fiber felt, a porous carbon-based material, a titanium plate and a titanium mesh. On the one hand, it is required that the current collector is resistant to not only chemical erosion but also electrochemical erosion; on the other hand, the current collector has good conductivity, and is cheap in price and convenient to process.

Further, the coating density of the slurry is 0.2-5 $kg/m^2$.

Further, the drying conditions comprise: pre-drying for 3-6 hours at a low temperature of 60-80° C., and then drying for 5-10 hours at a high temperature of 80-120° C. The electrode is firstly dried at the low temperature, one the one hand, which can avoid that lots of the solvent N-methyl pyrrolidone are evaporated at an initial stage so as to cause PVDF inside the electrode to be migrated onto the surface of the electrode with the solvent to form an organic layer, thereby reducing the hydrophilicity of the electrode plate; and on the other hand, can avoid that large cracks are formed on the surface of the electrode due to violent evaporation of the solvent, thereby leading to the reduction in the structure strength of the material. Through combination of segmented drying and water leaching, solution mass transfer channels with "porous-microcrack" can be formed on the surface and the interior of the electrode, which is conducive to improvement of the permeability of the electrode plate, thereby achieving the purposes of strengthening the mass transfer process of the solution and improve the current density.

The present disclosure also provides a preparation method of a high-conductivity porous electrode for extracting lithium in a salt lake, comprising the following steps:

(1) adding inorganic nano particles, a polar polymer organic matter and a binder into an organic solvent, and mechanically stirring for 4-8 hours in vacuum to obtain a composite blending modified glue solution;
(2) adding an electrode active material, acetylene black, carbon nano tubes, short-carbon fibers and a pore forming agent into the glue solution in step (1), and mechanically stirring for 6-10 hours in vacuum to obtain an electrode slurry;
(3) coating the electrode slurry obtained in step (2) on a current collector, and then performing segmented drying to obtain an electrode; and
(4) putting the electrode obtained in step (3) into a mixed aqueous solution containing sodium dodecyl benzene sulfonate and a conductive polymer monomer to be soaked for 2-8 h, then adding a $FeCl_3$ solution at 0-5° C., and reacting for 2-10 hours to obtain the high-conductivity porous electrode for extracting lithium in the salt lake.

Further, the inorganic nano particle is a mixture of one or more of inorganic nano oxides, preferably silicon dioxide, zirconium dioxide, titanium dioxide and aluminum oxide; the particle size of the inorganic nano particle is 10-100 nm, and the addition amount of the inorganic nano particles is 0.5%-2% of the weight of the binder.

Further, the polar polymer organic matter is a mixture of one or two of polyacrylic acid and polymethacrylic acid, and the addition amount of the polar polymer organic matters is 10%-30% of the weight of the binder.

Specifically, the property of the glue solution is strongly relevant to the performance of the electrode. The hydrophilicity of the binder in the glue solution can be inherited to the final electrode. Therefore, the hydrophilicity of the electrode can be improved through hydrophilic modification of the binder in the glue solution. Since the surfaces of the inorganic nano particles have many hydroxyl groups, water molecules easily generate hydrogen bonds with —OH on the surfaces and have hydrophilic strong-polarity surfaces; similarly, polar polymer organic matters also have hydrophilic groups such as hydroxyl and carboxyl. Therefore, PVDF can be subjected to doping and blending modification by adding inorganic nano particles and polar polymer matters in the glue-making process of PVDF, and then the hydrophilicity of the electrode is improved.

Further, the pore forming agent is an inorganic salt that is easily decomposed by heating, which is preferably a mixture of one or more of ammonium carbonate, ammonium bicarbonate and ammonium oxalate.

Specifically, a certain proportion of easily pyrolyzable solid salts are added in the preparation process of the electrode slurry, and these solid salt particles can be evenly dispersed on the surface and the interior of the electrode in the preparation process of the electrode slurry. Since these solid salts are easily decomposed by heating, decomposition and evaporation of the solid salts in the drying process of the electrode can retain the original positions of the solid salts inside the electrode so that the electrode shows a porous morphology. These porous structures provide good channels for diffusion and mass transfer of the solution inside the electrode, thereby effectively improving the mass transfer of the solution inside the electrode. Since the drying temperature of the electrode is generally below 12° C., the pyrolysis temperature of the selected easily pyrolyzable solid salts must be within the drying temperature of the electrode.

Further, the segmented drying comprises: pre-drying for 4-8 hours at 60-80° C., and then drying for 5-10 hours at 90-120° C.

Through the segmented drying method of "first low temperature and then high temperature", it is directly avoided that the electrode is hydrophobic due to enrichment of excessive PVDF binders on its surface after direct high-temperature drying; on the other hand, the first low temperature can allow lots of microcracks to be formed on the electrode, which is conducive to diffusion of the lithium ions inside the electrode so that an adsorption rate is improved and the electrode has high strength and high permeability. In addition, low-temperature pre-drying can effectively control the decomposition of the pore forming agent, thereby avoiding collapse of holes caused by a fact that lots of the pore forming agents are decomposed by direct high-temperature drying.

Further, the conductive polymer monomer is a mixture of one or more of pyrroles, thiophenes, anilines and indoles. Specifically, these conductive polymer monomers can be polymerized in an aqueous solution system through conventional chemical oxidative catalysis, and particularly a polymer coating layer is easily formed on the surface of the solid. The conductivity and the hydrophilicity of the whole electrode can be further improved by coating conductive polymers on the surfaces of the electrode and the particles.

Specifically, the obtained electrode is put into a mixed aqueous solution containing sodium dodecyl benzene sulfonate and a conductive polymer monomer to be soaked for 2-8 h, then a $FeCl_3$ solution is added at 0-5° C., the electrode is taken out after reacting for 2-10 hours and washed with water until the washing water was neutral, so as to obtain the modified porous electrode. The electrode is soaked in the mixed solution of conductive polymer monomers, which is mainly aimed at allowing the conductive polymer monomer components penetrate through the holes of the electrodes in advance to enter the interior of the electrode so that a coating layer is formed on the surfaces of the particles inside the electrode when a conductive polymer coating layer is formed through subsequent $FeCl_3$ catalysis.

Further, a molar ratio of addition amounts of the electrode active material, sodium dodecyl benzene sulfonate, ferric trichloride and the conductive polymer monomer is preferably 5:(1-2.5):(1-2.5):(0.5-2).

It can be understood that in the coating modification process of the conductive polymer, the addition proportion of each material can significantly affect the property of the final product. The polymerization degree of the conductive polymer monomer is directly relevant to the addition amount of ferric trichloride, and a proportion relationship between the weights of the conductive polymer monomer and the active material is also directly relevant to the thickness of the coating layer.

The preparation method of the high-conductivity porous electrode for extracting lithium in the salt lake of the present disclosure comprises: performing blending modification on the binder in the preparation process of the electrode by using inorganic nano particles and polar polymer organic matters so as to improve the hydrophilicity of the binder. In the preparation process of the electrode slurry, holes with different sizes are formed in the drying process of the electrode by adding an inorganic salt pore forming agent that is easily decomposed by heating, so as to improve the mass transfer effect of the solution inside the electrode plate. Finally, the prepared electrode material is subjected to chemical surface modification in the conductive polymer monomer solution, which can not only improve the conductivity of the whole electrode but also further improve the hydrophilicity of the whole electrode. By extracting lithium with the electrode of the present disclosure, the current density is significantly improved compared with that of the electrode prepared using the existing technology. Besides, the preparation method of the electrode disclosed in the present disclosure has the characteristics of simpleness and feasibility, environmental friendliness, low cost and the like, and is easy for industrial production.

The present disclosure also provides a preparation method of a composite electrode material for extracting lithium. The electrode active material for extracting lithium is subjected to surface coating modification by using polydopamine, the affinity and lithium selectivity of the electrode active material on the solution because polydopamine has preferable aggregation and transfer of lithium ions and hydrophilic features; in the preparation process of the electrode, the traditional PVDF binder is replaced with an aqueous binder, thereby further improving the hydrophilicity of the electrode; through addition of the pore forming agent and the segmented drying, a "porous-microcrack" composite structure is formed in the electrode, so as to strengthen the mass transfer of the solution inside the electrode. On this basis, by adding a fiber structure reinforcing agent, the strength of the electrode structure is ensured and improved and the falling off of the electrode material is avoided.

Specifically, the electrode active material for extracting lithium is soaked into the dopamine solution to be reacted so as to obtain a polydopamine modified electrode active material; a conductive agent is subjected to surface treatment in a strong acidic solution, and then undergoes alkaline washing and water washing in turn until the solution is neutral, so as to obtain a modified conductive agent; the polydopamine modified electrode active material, the modified conductive agent, the aqueous binder, the structure reinforcing agent, the pore forming agent and water are mixed and pulped in a certain proportion to obtain a slurry; the slurry is coated on a current collector to undergo drying and water leaching treatment, so as to obtain the composite porous electrode material for extracting lithium.

Further, the adopted composite porous electrode material for extracting lithium is one of lithium iron phosphate, lithium manganate or lithium nickel cobalt manganate.

Specifically, the above electrode active material has transfer and migration channels of lithium ions, redox reaction sites and chemically stable lattice structure and the like, should have stable electrochemical working windows in the aqueous solution. By controlling the redox potential of the electrode, lithium ions can be selectively intercalated and de-intercalated from the material.

Further, in the polydopamine modification process of the electrode active material, the polydopamine solution has a concentration of 0.5-5 g/L, a pH value of 7.5-10, a reaction temperature of 10-40° C. and reaction time of 10-20 h; a solid-to-liquid ratio of the electrode active material to the dopamine solution is 1:5-10. In the polydopamine modification process of the active material, when being in contact with air under a weakly alkaline condition, the dopamine can be polymerized on the surfaces of the particles and a polydopamine coating layer is formed. Under an acidic condition, there is a need to add a certain catalyst, and the dissolution and denaturation of the active material are easily caused under a strong alkaline condition. Therefore, at a weakly alkaline environment, polydopamine surface coating through air oxidization has the characteristics of simpleness and feasibility.

Further, the adopted conductive agent is a mixture of one or more of acetylene black, Ketjen black, super P, conductive graphite powder KS-6, carbon nano tubes and graphene. These conductive agents are made of carbon materials, which are resistant to chemical corrosion and electrical corrosion, and have the characteristic of large specific area, so small addition amounts of these conductive agents can improve the conductivity of the electrode.

Since the selected conductive agent is made of the carbon material, so its surface is hydrophobic. However, the electrode described in the present application needs to work in an aqueous solution system. It is necessary to perform hydrophilic modification on the conductive agent in order to make the electrode have better hydrophilicity, wherein it is one of effective ways to carry out oxidative strong acid treatment on the conductive agent. Specifically, the adopted strong acidic solution is preferably 20-65 wt. % nitric acid or 50-85 wt. % sulfuric acid. Meanwhile, by comprehensively considering treatment effects and economic benefits, the acidizing time is preferably 1-12 h, and the acidizing temperature is preferably 20-60° C.

Further, the adopted pore forming agent is a soluble solid salt, preferably, a mixture of one or more of NaCl, KCl, $Na_2CO_3$, $K_2CO_3$, $Na_2SO_4$ and $K_2SO_4$.

Specifically, in the preparation process of the electrode slurry, the soluble salt can be dissolved into water to be evenly distributed. However, in the drying process of the slurry after coating, the solid salt can be gradually crystallized and separated out with the evaporation of water and then evenly dispersed inside the electrode. These soluble salts are de-intercalated from the dried electrode through water leaching treatment, so as to form holes with different sizes inside the electrode. The existence of these holes provides an effective pathway for mass transfer of the solution inside the electrode, thereby significantly improving the mass transfer effect of the solution inside the electrode, improving the electrochemical performance of the electrode and facilitating the working of the electrode under a high current density. Meanwhile, improvement of the mass transfer effect of the solution can reduce the concentration polarization of the lithium extraction process, so as to provide good basic conditions for treating the salt lake brine with a low lithium concentration.

Further, the adopted aqueous binder is one of polyurethane, methyl polyacrylate, polyacrylic acid.

Specifically, the selected aqueous binder adopts an aqueous solution as a solvent, which avoids the traditional organic solvent N-methyl pyrrolidone, so the aqueous binder is lower in cost and more environmental friendly. More important, these aqueous binders are organic matters containing amino or carboxyl hydrophilic groups, which have better phydrophilicity than that of the traditional PVDF binder, and are conducive to improving the contact between the interface of the electrode active particles and the solution, reducing the resistance of the interface and improving the electrochemical performance.

Further, the adopted structure reinforcing agent is a mixture of one or more of polypropylene fibers, lignin fibers, carbon fibers, basalt fibers, polyester fibers, cellulose fibers and glass fibers. It can be understood that after pore formtion is performed on the electrode, the whole strength of the electrode is easily reduced, and then the material falls off and is bumped. Through addition of a certain amount of fiber materials, it can take the effect of "reinforcement cages" so as to strengthen the structure strength of the electrode.

Further, in the preparation process of the electrode, the addition amounts of the modified conductive agent, the aqueous binder, the structure reinforcing agent, the pore forming agent and water are 8%-12%, 5-15%, 0.5%-5%, 20-40% and 150%-300% the weight of the polydopamine modified electrode active material.

Specifically, on the premise of ensuring that the final material has good hydrophilicity, conductivity and permeability, the addition amounts of the modified conductive agent, the aqueous binder, the structure reinforcing agent, the pore forming agent and water in the slurry need to be controlled within a certain proportion range. On the one hand, too small addition amounts of the binder, the conductive agent and short-carbon fiber and the like cannot well ensure the hydrophilicity, the conductivity and the structure strength required by the electrode material; too large addition amounts easily cause too low proportion of the electrode active material, so as not to facilitate the exertion of the electrochemical performance; as a solvent in the preparation process of the slurry and a control agent of slurry flowability, if the addition amount of water is too small, on the one hand, the binder and the pore forming agent can be insufficiently dissolved, and the viscosity of the final slurry is too high, which is not conducive to coating of the slurry on the current collector; on the other hand, if the addition amount of water is too large, the viscosity of the slurry is not enough, the slurry is difficult to effectively coat, and solid substances are easily settled and layered in the drying process, thereby leading to imbalanced proportion of the final material and sharp reduction in electrochemical performance. For the pore forming agent, too large addition amount easily causes poor electrode strength, but too small addition amount results in too low electrode porosity, which is not conducive to the mass transfer of the solution inside the electrode.

Further, the adopted drying mechanism is as follows: drying for 4-8 hours at 60-80° C., and drying for 3-8 hours at 80-120° C.

It can be understood that low-temperature pre-drying of the electrode can effectively avoid a risk caused by a fact that lots of water is evaporated at the initial stage so that large cracks are formed on the surface of the electrode so as to reduce the structure strength of the material and allow the material to easily fall off. Through combination of segmented drying and water leaching, the solution mass transfer channels with "porous-microcracks" can be formed on the surface and the interior of the electrode, which facilitates the improvement of the permeability of the electrode plate so as to achieve the purposes of strengthening the mass transfer of the solution and improving the low-temperature current density.

Compared with the prior art, the present disclosure mainly has the beneficial effects:

(1) the selectivity and the current density of the electrode material are improved through polydopamine coating modification of the electrode active material;

(2) by regulating the pore forming agent and drying mechanism, the electrode has solution mass transfer channels with "porous-microcrack", which is conducive to diffusion of lithium ions inside the electrode and improvement of lithium extraction rate;

(3) short-carbon fibers are added in the preparation process of the electrode, which takes the effect of "reinforcement cage", thereby improving the mechanical strength of the electrode, effectively avoiding the falling off of the electrode material and facilitating the cycle stability of the electrode; and (4) the preparation method disclosed in the present disclosure is simple in process, low in cost and the like, and is easy for industrial production on large scale.

DETAILED DESCRIPTION OF THE EMBODIMENTS

Figure 1:
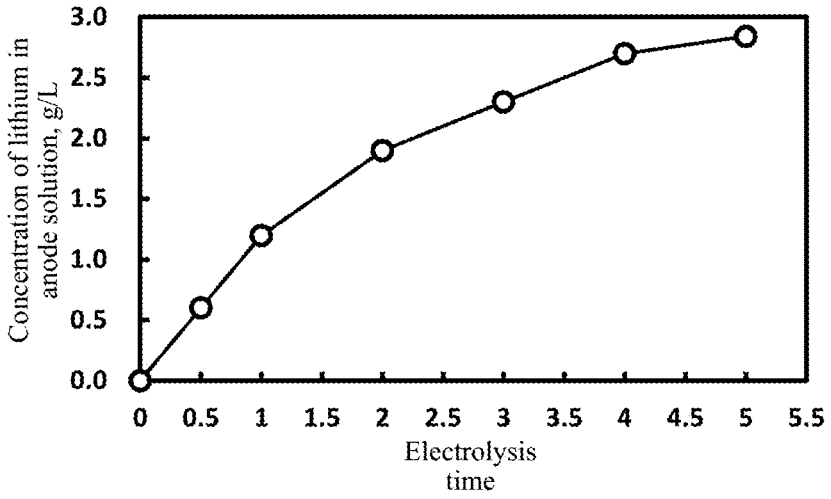
FIG. 1 is a curve of change in concentration of lithium in an anode solution with lithium extraction time in example 1 of the present disclosure.

Next, specific embodiments of the present disclosure will be further described in detail in combination with examples. The following examples are used for illustrating the present disclosure but not limiting the scope of the present disclosure.

Example 1

Preparation of lithium ferric phosphate electrode: (1) a lithium ferric phosphate active material was put into a 5 g/L polydopamine salt solution in a solid-to-liquid mass ratio of 1:5 while a reaction temperature was controlled at 20° C. and the pH value of the solution was adjusted to 8.5, the above solution was stirred to react for 15 h, the obtained reaction product was filtered and washed after the reaction was ended, and then filter residue was dried at 100° C.;

(2) polyethylene glycol and PVDF were added into an N-methyl pyrrolidone solvent, and the above materials were mechanically stirred in vacuum until being completely dissolved;

(3) polydopamine modified lithium ferric phosphate powders, acetylene black, a pore forming agent solid NaCl and short-carbon fibers having a length of 2 mm were added into an N-methyl pyrrolidone glue solution in a proportion, and then the above materials were mechanically stirred in vacuum for 6 hours to obtain an evenly dispersed electrode slurry;

(4) the obtained electrode slurry was evenly coated on a titanium mesh having a thickness of 1 mm and an area of 40 cm×50 cm, and the coating density of the lithium ferric phosphate active material after drying was controlled to 2 kg/m', and (5) the coated lithium ferric phosphate electrode was dried for 6 hours at 60° C. and then for 6 hours at 100° C. in a blast drying oven, the dried electrode plate was soaked in tap water until NaCl was completely dissolved, and a finished product electrode was obtained by drying in air, wherein the addition amounts of polyethylene glycol, PVDF, acetylene black, KCl, short-carbon fibers and N-methyl pyrrolidone were successively 5%, 10%, 8%, 20%, 3% and 150% of the weight of the electrode powders; the particle size mass distribution of solid NaCl was as follows: 50-100 meshes of the solid NaCl accounted for 25%, 100-200 meshes of the solid NaCl accounted for 40%, and more than 200 meshes of the solid NaCl accounted for 35%.

Experiment for extracting lithium: the prepared lithium ferric phosphate electrode serving as an anode and foamed nickel serving as a cathode were placed into a 20 g/L NaCl solution, 1.0 V of voltage was applied to two ends of the electrode until a current density was lower than 0.5 A/m$^2$, so as to prepare an under-lithium $Li_{1-x}FePO_4$ electrode. An electrolysis device was divided into a cathode chamber and an anode chamber by using an anionic membrane, and the prepared lithium ferric phosphate electrode and under-lithium $Li_{1-x}FePO_4$ electrode were respectively placed into the anode chamber and the cathode chamber. 24 L of to-be-treated brine comprising components as shown in Table 1 was injected into the cathode chamber and 4 L of 5 g/L NaCl solution serving as a support electrolyte was injected to the anode chamber. 0.3 V of voltage was applied to the cathode and the anode. After electrolysis for 5 hours at 5° C., the concentration of lithium in the brine was reduced to 0.08 g/L; the concentration of lithium in the anode lithium-enriched solution was increased to 2.82 g/L, the adsorption capacity of the electrode was 28.4 mg(Li)/g ($LiFePO_4$), and the average current density of the electrode was 43.7 A/m$^2$.

TABLE 1

| Components of brine | Li | Na | Mg | K | B | $SO_4^{2-}$ |
|---|---|---|---|---|---|---|
| Concentration (g/L) | 0.55 | 55.30 | 28.30 | 4.87 | 1.85 | 15.24 |

The cathode and the anode after extraction of lithium were exchanged, brine and NaCl were injected again into the cathode and the anode, then lithium was extracted after electrifying, and all the conditions were maintained to be unchanged. After continuous electrolysis for 5 h, the concentration of lithium in the brine was reduced to 0.079 g/L, the concentration of lithium in the anode lithium-enriched solution was increased to 2.83 g/L, the adsorption capacity of the electrode was 28.5 mg(Li)/g ($LiFePO_4$), and the average current density of the electrode was 43.8 A/m$^2$. The changes in concentrations of lithium in the brine and the lithium-enriched solution before and after extraction of lithium are seen in Table 2 below. It can be seen from the electrodes can well intercept other impurity ions in the process of extracting lithium, with an interception rate being basically maintained to more than 98%, exhibiting good selectivity.

TABLE 2

| Elements (g/L) | Li | Na | Mg | K | $B_2O_3$ | $SO_4^{2-}$ |
|---|---|---|---|---|---|---|
| Brine after extraction of lithium | 0.08 | 55.25 | 28.27 | 4.86 | 1.84 | 15.23 |
| Anode solution | 2.84 | 3.11 | 0.59 | 0.10 | 0.04 | 0.27 |

Figure 2:
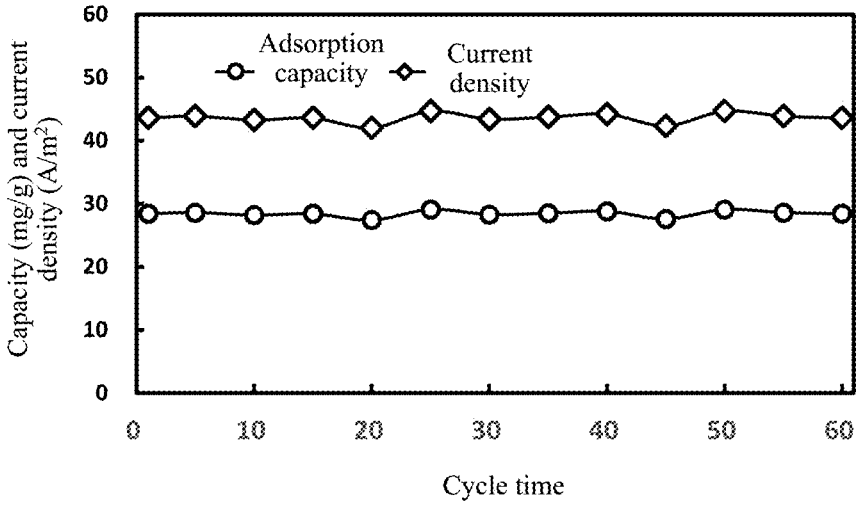
FIG. 2 shows circulation performance of an electrode in example 1 of the present disclosure.
Figure 5:
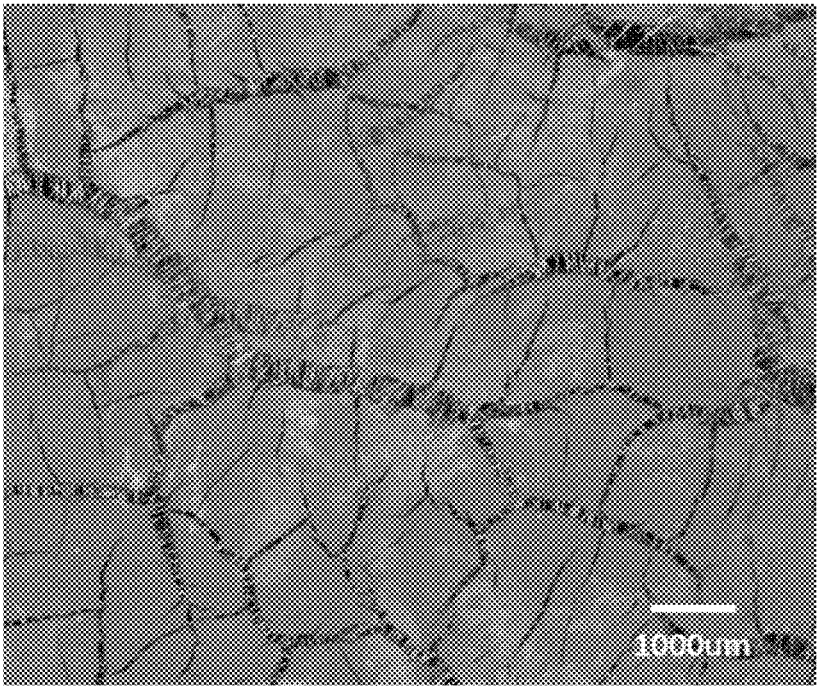
FIG. 5 is an optical morphology graph of an electrode in example 1 of the present disclosure.

FIG. 1 is a curve of change in concentration of lithium in an anode solution with electrolysis time, FIG. 2 shows circulation performance of an electrode in the process of extracting lithium under the same conditions after the cathode and the anode were exchanged after each lithium extraction process is ended and then brine and NaCl support electrolyte are injected again. It can be seen that the lithium ferric phosphate electrode prepared in this example has good cycle performance. FIG. 5 is an optical morphology graph of an electrode in example 1.

The brine with a low lithium concentration was treated by adopting the same conditions and process parameters as those above. 50 L of to-be-treated brine was injected into the cathode chamber and 4 L of 5 g/L NaCl solution serving as a support electrolyte was injected to the anode chamber. 0.2 V of voltage was applied to the cathode and the anode, and then continuous electrolysis was performed for 8 hours at 5° C. Changes of concentrations of lithium in the brine and the anode solution before and after extraction of lithium are seen in Table 3. It can be from the table that after 8 h, the concentration of lithium in the brine was reduced from 0.25 g/L to 0.06 g/L, the concentration of lithium in the anode lithium-enriched solution was increased to 2.36 g/L, the adsorption capacity of the electrode was 23.6 mg(Li)/g ($LiFePO_4$), and the average current density of the electrode was 22.7 $A/m^2$.

TABLE 3

| Components in brine | Li | Na | Mg | K | $B_2O_3$ | $SO_4^{2-}$ |
|---|---|---|---|---|---|---|
| Brine | 0.25 | 33.20 | 37.90 | 5.43 | 2.03 | 11.24 |
| Brine after extraction of lithium | 0.06 | 33.15 | 37.84 | 5.42 | 2.03 | 11.22 |
| Anode solution | 2.36 | 2.66 | 0.80 | 0.11 | 0.04 | 0.20 |

Comparative Example 1

$LiFePO_4$, acetylene black and PVDF were added into an N-methyl pyrrolidone organic solvent in a weight ratio of 8:1:1 to be evenly mixed, the obtained mixture was grinded to form a pulp, the pulp was coated on a titanium mesh current collector used in example 1 (a coating thickness was the same), an electrode was dried for 12 hours in a vacuum oven at 110° C., subsequently, a lithium ferric phosphate contrast electrode was obtained after cooling, and a group of under-lithium electrodes were prepared from this electrode using the same method.

Similar to the experiment conditions in example 1, 50 L of 0.25 g/L brine was injected to the cathode chamber; 4 L of 5 g/L NaCl solution serving as a support electrolyte was injected into the anode. 0.2 V of voltage was applied to the cathode and the anode to perform continuous electrolysis for 15 hours at 5° C. Changes in components in the solution before and after extraction of lithium are seen in Table 4. It can be seen that by extracting lithium with the contrast electrode, the concentration of lithium in the brine was reduced from 0.25 g/L to 0.14 g/L, the adsorption capacity of the electrode was 15.1 mg(Li)/g ($LiFePO_4$), and the average current density of the electrode was 7.18 $A/m^2$ which is lower than that of the same brine treated in example 1.

In addition, it can be seen by comparing the concentrations of impurity ions that the concentrations of the impurity ions in the obtained lithium-enriched solution prepared in example 1 are lower, indicating that coating of polydopamine on the surface of the electrode takes the effect of preferentially transmitting lithium.

TABLE 4

| Components in brine | Li | Na | Mg | K | $B_2O_3$ | $SO_4^{2-}$ |
|---|---|---|---|---|---|---|
| Brine | 0.25 | 33.20 | 37.90 | 5.43 | 2.03 | 11.24 |
| Brine after extraction of lithium | 0.14 | 33.07 | 37.73 | 5.41 | 2.02 | 11.22 |
| Anode solution | 1.40 | 3.66 | 2.12 | 0.29 | 0.13 | 0.26 |

Example 2

Preparation of lithium ferric phosphate electrode: (1) a lithium ferric phosphate active material was put into a 2 g/L polydopamine salt solution in a solid-to-liquid mass ratio of 1:5 while a reaction temperature was controlled at 25° C. and the pH value of the solution was adjusted to 9, the above solution was stirred to react for 20 h, the obtained reaction product was filtered and washed after the reaction was ended, and then filter residue was dried at 100° C.;

(2) polyethylene glycol, chitosan and PVDF were added into an N-methyl pyrrolidone solvent, and the above materials were mechanically stirred until being completely dissolved;

(3) polydopamine modified lithium ferric phosphate powders, a conducive agent acetylene black, a pore forming agent solid KCl and short-carbon fibers having a length of 1 mm were added into an N-methyl pyrrolidone glue solution in a proportion, and then the above materials were mechanically stirred in vacuum for 6 hours to obtain an evenly dispersed electrode slurry;

(4) the obtained electrode slurry was evenly coated on a carbon fiber cloth having a thickness of 1 mm and an area of 40 cm×50 cm, and the coating density of the lithium ferric phosphate active material after drying was controlled to 2.8 $kg/m^2$; and (5) the coated lithium ferric phosphate electrode was dried for 6 hours at 70° C. and then for 10 hours at 90° C. in a blast drying oven, the dried electrode plate was soaked in tap water until KCl was completely dissolved, and a finished product electrode was obtained by removing and drying in air, wherein the addition amounts of polyethylene glycol, chitosan, PVDF, acetylene black, KCl, short-carbon fibers and N-methyl pyrrolidone were successively 4.5%, 12%, 10%, 30%, 2.5% and 180% of the weight of the electrode powders; the particle size mass distribution of solid KCl was as follows: 50-100 meshes of the solid KCl accounts for 25% of the weight of the total pore forming agent, 100-200 meshes of the solid KCl accounts for 50% of the weight of the total pore forming agent, and more than 200 meshes of the solid KCl accounts for 25% of the weight of the total pore forming agent.

Preparation of an under-lithium $Li_{1-x}FePO_4$ electrode was the same as that in example 1. The prepared lithium ferric phosphate electrode with the carbon fiber cloth as a current collector and the under-lithium $Li_{1-x}FePO_4$ electrode were respectively placed in an anode chamber and a cathode chamber. 24 L of to-be-treated brine was injected into the cathode chamber and 4 L of 5 g/L NaCl solution serving as a support electrolyte was injected to the anode chamber. 0.2 V of voltage was applied to the cathode and the anode, and then lithium was continuously extracted at 10° C. After continuous electrolysis for 8 h, the concentration of lithium in the brine was reduced to 0.11 g/L, the concentration of lithium in the anode lithium-enriched solution was increased to 4.51 g/L, the adsorption capacity of the electrode was 32.2 mg(Li)/g ($LiFePO_4$), and the average current density of the electrode was 43.35 $A/m^2$. The change in concentrations of the solution after and before extraction of lithium is seen in Table 5.

TABLE 5

| Components of brine | Li | Na | Mg | K | B | $SO_4^{2-}$ |
|---|---|---|---|---|---|---|
| Brine | 0.84 | 33.20 | 84.50 | 5.43 | 0.85 | 9.34 |
| Brine after extraction of lithium | 0.11 | 33.09 | 84.21 | 5.41 | 0.84 | 9.31 |
| Anode solution | 4.51 | 2.66 | 1.77 | 0.11 | 0.02 | 0.17 |

Example 3

Preparation of lithium manganate electrode: (1) a lithium manganate phosphate active material was put into a 4 g/L polydopamine salt solution in a solid-to-liquid mass ratio of 1:5 while a reaction temperature was controlled at 20° C. and the pH value of the solution was adjusted to 9.5, the above solution was stirred to react for 10 h, the obtained reaction product was filtered and washed after the reaction was ended, and then filter residue was dried at 100° C.;

(2) polyethylene glycol, polyvinyl alcohol and PVDF were added into an N-methyl pyrrolidone solvent, and the above materials were mechanically stirred until being completely dissolved;

(3) polydopamine modified lithium manganate powders, acetylene black, a pore forming agent solid NaCl and short-carbon fibers having a length of 2.5 mm were added into an N-methyl pyrrolidone glue solution in a proportion, and then the above materials were mechanically stirred in vacuum for 8 hours to obtain an evenly dispersed electrode slurry;

(4) the obtained electrode slurry was evenly coated on a carbon fiber cloth having a thickness of 1 mm and an area of 40 cm×50 cm, and the coating density of the lithium ferric phosphate active material after drying was controlled to 3 kg/m$^2$; and (5) the coated lithium manganate electrode was dried for 5 hours at 60° C. and then for 8 hours at 100° C. in a blast drying oven, the dried electrode plate was soaked in tap water until NaCl was completely dissolved, and a finished product electrode was obtained by drying in air, wherein the addition amounts of polyvinyl alcohol (50%), polyethylene glycol (50%), PVDF, acetylene black, KCl, short-carbon fibers and N-methyl pyrrolidone were successively 3%, 8%, 13%, 30%, 25%, 1% and 180% of the weight of the electrode powders; the particle size mass distribution of the solid KCl was as follows: 50-100 meshes of the solid KCl accounts for 20% of the weight of the total pore forming agent, 100-200 meshes of the solid KCl accounts for 40% of the weight of the total pore forming agent, and more than 200 meshes of the solid KCl accounts for 40% of the weight of the total pore forming agent.

Preparation of an under-lithium $Li_{1-x}Mn_2O_4$ electrode was the same as that in example 1. The prepared lithium manganate electrode and the under-lithium $Li_{1-x}Mn_2O_4$ electrode were respectively placed in an anode chamber and a cathode chamber. 7 L of to-be-treated brine was injected into the cathode chamber and 2 L of 5 g/L NaCl solution was injected to the anode chamber. 0.6 V of voltage was applied to the cathode and the anode. After continuous electrolysis for 5 hours at 20° C., the concentration of lithium in the brine was reduced from 1.84 g/L to 0.13 g/L, the concentration of lithium in the anode lithium-enriched solution was increased to 6.15 g/L, the adsorption capacity of the electrode was 20.5 mg(Li)/g ($LiMn_2O_4$), and the average current density of the electrode was 59.1 A/m$^2$. The change in concentrations of the solution after and before extraction of lithium is seen in Table 6. It can be seen that the electrode of the present disclosure has a good magnesium and lithium separation effect.

TABLE 6

| Components of brine | Li | Na | Mg | K | $B_2O_3$ | $SO_4^{2-}$ |
|---|---|---|---|---|---|---|
| Brine | 1.84 | 1.42 | 114.50 | 0.52 | 11.30 | 28.50 |
| Brine after extraction of lithium | 0.13 | 1.41 | 114.18 | 0.52 | 11.23 | 28.36 |
| Anode solution | 6.15 | 2.03 | 1.15 | 0.01 | 0.24 | 0.51 |

Comparative Example 2

Lithium manganate, acetylene black and PVDF were added into an N-methyl pyrrolidone organic solvent in a weight ratio of 8:1:1 to be evenly mixed, the obtained mixture was grinded to form a pulp, the pulp was coated on a ruthenium-coated titanium mesh current collector used in example 3 (a coating thickness was the same), an electrode was dried for 12 hours in a vacuum oven at 110° C., subsequently, a lithium manganate contrast electrode was obtained after cooling, and a group of under-lithium electrodes were prepared from this electrode using the same method.

Figure 3:
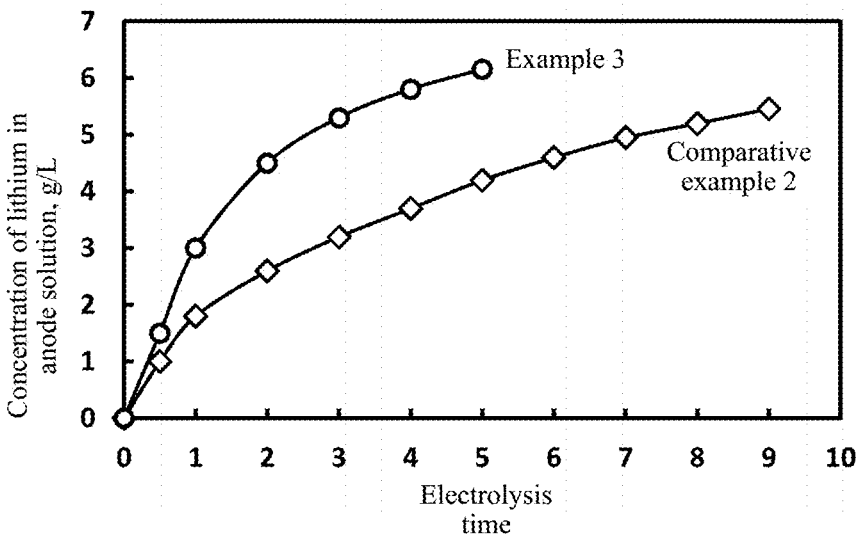
FIG. 3 shows changes in concentrations of lithium in anode solutions of electrodes prepared in example 3 and comparative example 2 of the present disclosure during the extraction of lithium with time.

1.84 g/L brine in example 3 was treated based on the same technical parameters. 7 L of brine was injected to the cathode chamber; 2 L of 5 g/L NaCl solution serving as a support electrolyte was injected into the anode. 0.6 V of voltage was applied to the cathode and the anode. After continuous electrolysis for 9 hours at 20° C., the concentration of lithium in the brine was reduced from 1.84 g/L to 0.24 g/L, the adsorption capacity of the electrode was 18.2 mg(Li)/g ($LiMn_2O_4$), and the average current density of the electrode was 23.33 A/m$^2$; the concentrations of Mg, K, $B_2O_3$ and $SO_4^{2-}$ in the anode solution were 3.54 g/L, 0.08 g/L, 0.36 g/L and 1.21 g/L, respectively. FIG. 3 shows changes in concentrations of lithium in anode solutions of electrodes prepared in example 3 and comparative example 2 of the present disclosure during the extraction of lithium with time. It can be seen from data of example 2 and comparative example 2 that when 1.84 g/L brine having a high magnesium-lithium ratio is treated similarly, the current density in this example is only 40% that in example 3, and the interception rate of impurity ions is also reduced.

Example 4

Preparation of $LiNi_{1/3}Co_{1/3}Mn_{1/3}O_2$ electrode: (1) a $LiNi_{1/3}Co_{1/3}Mn_{1/3}O_2$ ternary active material was put into a 4 g/L polydopamine salt solution in a solid-to-liquid mass ratio of 1:5 while a reaction temperature was controlled at 15° C. and the pH value of the solution was adjusted to 9-10, the above solution was stirred to react for 10 h, the obtained reaction product was filtered and washed after the reaction was ended, and then filter residue was dried at 100° C.;

(2) chitosan and PVDF were added into an N-methyl pyrrolidone solvent, and the above materials were mechanically stirred until being completely dissolved;

(3) polydopamine modified $LiNi_{1/3}Co_{1/3}Mn_{1/3}O_2$ powders, acetylene black, a pore forming agent solid $Na_2SO_4$ and short-carbon fibers having a length of 2 mm were added into an N-methyl pyrrolidone glue solution in a proportion, and then the above materials were mechanically stirred in vacuum for 7 hours to obtain an evenly dispersed electrode slurry;

(4) the obtained electrode slurry was evenly coated on a carbon fiber felt having a thickness of 1 mm and an area of 40 cm×50 cm, and the coating density of the ternary active material after drying was controlled to 1.5 kg/m$^2$; and (5) the coated ternary electrode was dried for 5 hours at 60° C. and then for 8 hours at 80° C. in a blast drying oven, the dried electrode plate was soaked in tap water until $Na_2SO_4$ was completely dissolved, and a finished product electrode was obtained by removing and drying in air, wherein the addition amounts of chitosan, PVDF, acetylene black, $Na_2SO_4$, short-carbon fibers and N-methyl pyrrolidone were successively 5%, 10%, 10%, 20%, 1.5% and 200% of the weight of the electrode powders; the particle size mass distribution of the solid $Na_2SO_4$ was as follows: 50-100 meshes of the solid $Na_2SO_4$ accounts for 30% of the weight of the total pore forming agent, 100-200 meshes of the solid $Na_2SO_4$ accounts for 40% of the weight of the total pore forming agent, and more than 200 meshes of the solid $Na_2SO_4$ accounts for 30% of the weight of the total pore forming agent.

Preparation of an under-lithium $Li_{1-x}Ni_{1/3}Co_{1/3}Mn_{1/3}O_2$ electrode is the same as that in example 1. The prepared $Li_{1-x}Ni_{1/3}Co_{1/3}Mn_{1/3}O_2$ electrode and the under-lithium $Li_{1-x}Ni_{1/3}Co_{1/3}Mn_{1/3}O_2$ electrode were respectively placed into an anode chamber and a cathode chamber. 8 L of to-be-treated brine was injected into the cathode chamber and 2 L of 5 g/L NaCl solution was injected to the anode chamber. 1.0 V of voltage was applied to the cathode and the anode. After continuous electrolysis for 3 hours at 5° C., the concentration of lithium in the brine was reduced from 0.67 g/L to 0.11 g/L, the concentration of lithium in the anode lithium-enriched solution was increased to 2.33 g/L, the adsorption capacity of the electrode was 15.5 mg(Li)/g ($Li_{1-x}Ni_{1/3}Co_{1/3}Mn_{1/3}O_2$), and the average current density of the electrode was 29.81 A/m$^2$. The change in concentrations of the solution after and before extraction of lithium is seen in Table 7.

TABLE 7

| Components of brine | Li | Na | K | $CO_3^{2-}$ | $B_2O_3$ | $SO_4^{2-}$ |
|---|---|---|---|---|---|---|
| Brine | 0.67 | 97.20 | 15.30 | 21.80 | 4.50 | 10.30 |
| Brine after extraction of lithium | 0.11 | 96.73 | 15.21 | 21.68 | 4.47 | 10.24 |
| Anode solution | 2.33 | 3.94 | 0.32 | 0.46 | 0.09 | 0.19 |

Comparative Example 3

Figure 4:
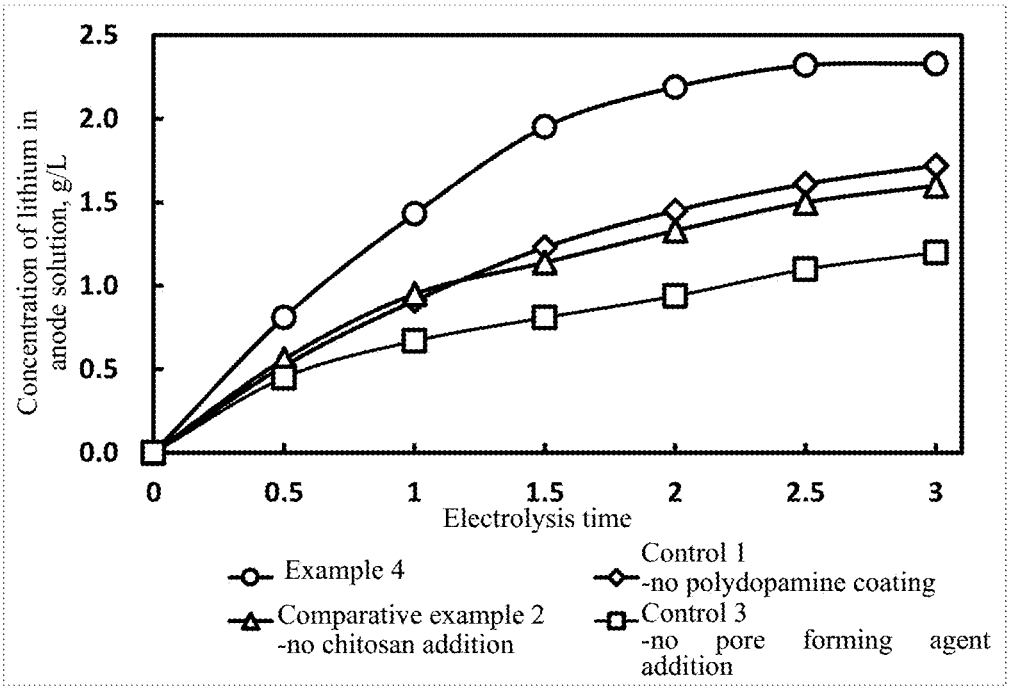
FIG. 4 shows changes in concentrations of lithium in anode solutions of electrodes prepared in example 4 and comparative example 3 of the present disclosure during the extraction of lithium with time.

Electrodes for extracting lithium were respectively prepared without polydopamine coating, addition of chitosan, hydrophilic modification and addition of pore forming agents under the conditions that other conditions unchanged by using preparation processes and experimental methods in example 4. FIG. 4 shows changes in concentrations of lithium in anode solutions of electrodes prepared in example 4 and comparative example 3 of the present disclosure during the extraction of lithium with time. By comparing data in FIG. 4, it can be seen that the preparation method of the present disclosure has the significant advantage of extracting lithium, and promotion of this advantage is obtained by modification from many aspects.

The specific examples of the preparation method of the high-conductivity porous electrode for extracting lithium in the salt lake of the present disclosure are as follows:

Example 5

Preparation of lithium ferric phosphate: (1) silicon dioxide having a particle size of 20-80 nm, polyacrylic acid and PVDF were added into an N-methyl pyrrolidone (NMP) solvent and then be mechanically stirred for 6 hours in vacuum to obtain a doped blending modified glue solution, wherein the addition amount of silicon dioxide was 1% of the weight of PVDF, and the addition amount of polyacrylic acid is 15% of the weight of PVDF;

(2) lithium ferric phosphate, acetylene black, carbon nano tubes, short-carbon fibers and a pore forming agent ammonium carbonate were added into the glue solution and then the above materials were mechanically stirred for 8 hours in vacuum to obtain an electrode slurry, wherein in the slurry, the addition amounts of the PVDF, the acetylene black, the carbon nano tubes, the short-carbon fibers, the pore forming agent and the N-methyl pyrrolidone were successively 10%, 10%, 0.5%, 2%, 40% and 200% of the weight of lithium ferric phosphate; the particle size distribution of ammonium carbonate is as follows: 50-100 meshes of ammonium carbonate accounts for 30% of the weight of the total pore forming agent, 100-200 meshes of ammonium carbonate accounts for 50% of the weight of the total pore forming agent, and more than 200 meshes of ammonium carbonate accounts for 20% of the weight of the total pore forming agent;

(3) the electrode slurry obtained in step (2) was evenly coated on a titanium mesh with an area of 30 cm×50 cm, and the coating density was controlled to 1.5 kg/m$^2$, and then the coated electrode was pre-dried for 6 hours at a low temperature of 70° C. followed by drying for 5 hours at a high temperature of 100° C.; and (4) the electrode dried in step (3) was put into a mixed solution containing 0.15 mol/L sodium dodecyl benzene sulfonate and a pyrrole monomer to be soaked for 3 h, then a 0.1 mol/L $FeCl_3$ solution was added at 5° C. to react for 8 h, wherein a molar ratio of electrode active material to sodium dodecyl benzene sulfonate to ferric trichloride to pyrrole monomer was 5:1.5:1.5:1. After the reaction was ended, the electrode plate was taken out and then washed with water until the washing water was neutral, so as to obtain a polypyrrole modified porous electrode.

Lithium extraction experiment: the prepared lithium ferric phosphate electrode serving as an anode and foamed nickel serving as a cathode were placed into a 20 g/L NaCl solution, 1.0 V of voltage was applied to two ends of the electrodes until the current density was lower than 0.5 A/m$^2$, so as to prepare a delithiated $Li_{1-x}FePO_4$ electrode.

Figure 6:
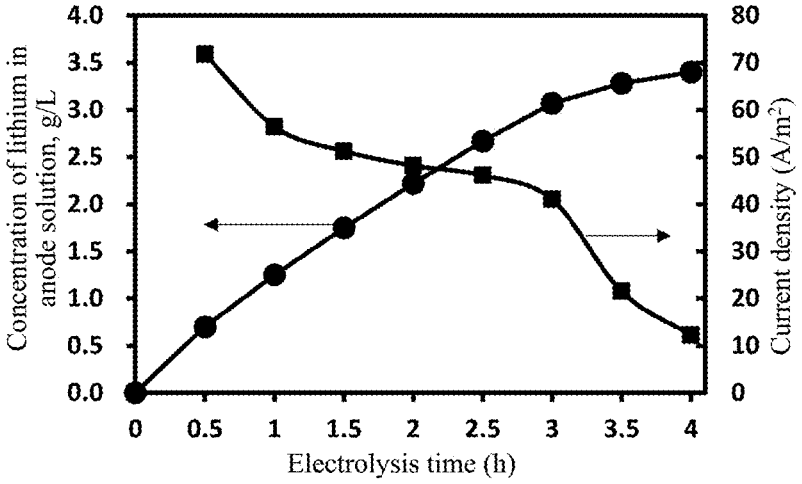
FIG. 6 is a curve of concentration of lithium ions in an anode solution and current density with time.

An electrolysis device was divided into a cathode chamber and an anode chamber by using an anionic membrane, and then the prepared lithium ferric phosphate electrode and the delithiated lithium ferric phosphate electrode were respectively placed into the anode chamber and the cathode chamber. 15 L of to-be-treated brine was injected into the cathode chamber and 2 L of 5 g/L NaCl solution serving as a support electrolyte was injected to the anode chamber. 0.3 V of voltage was applied to the cathode and the anode to perform electrolysis for 4 hours at 20° C. Components in the brine and the anode lithium-enriched solution before and after extraction of lithium are seen in Table 8. FIG. 6 is a curve of concentration of lithium ions in an anode solution and current density with time. It can be seen that the concentration of lithium in the brine is reduced from 0.54 g/L to 0.09 g/L; the concentration of lithium in the anode lithium-enriched solution is increased to 3.4 g/L, and a magnesium-to-lithium ratio is reduced from 97 in the brine to 0.26 in the lithium-enriched solution. After the electrolysis is ended, the adsorption capacity of the electrode is 30.2 mg (Li)/g($LiFePO_4$), and the average current density in the above process is 43.6 A/$m^2$.

TABLE 8

| Concentration (g/L) | Li | Na | Mg | K | $B_2O_3$ | $SO_4^{2-}$ |
|---|---|---|---|---|---|---|
| Brine | 0.54 | 53.70 | 52.40 | 4.05 | 2.67 | 10.67 |
| Brine after extraction of lithium | 0.09 | 53.56 | 52.28 | 4.04 | 2.66 | 10.64 |
| Anode lithium-enriched solution | 3.40 | 3.07 | 0.89 | 0.09 | 0.06 | 0.19 |

Example 6

Preparation of lithium ferric phosphate: (1) silicon dioxide having a particle size of 20-50 nm, polymethylacrylic acid and PVDF were added into an N-methyl pyrrolidone (NMP) solvent, wherein the addition amount of titanium dioxide was 2% the weight of PVDF, the addition amount of polymethylacrylic acid was 15% the weight of PVDF, and then the above materials were mechanically stirred for 5 hours in vacuum to obtain a doped blending modified glue solution;

(2) lithium ferric phosphate, acetylene black, carbon nano tubes, short-carbon fibers and ammonium bicarbonate were added into the glue solution and then mechanically stirred for 8 hours in vacuum at 20-30° C. to obtain an electrode slurry, wherein in the slurry, the addition amounts of the PVDF, the acetylene black, the carbon nano tubes, the short-carbon fibers, the pore forming agent and the N-methyl pyrrolidone were successively 9%, 12%, 1%, 3%, 35% and 150% of the weight of lithium ferric phosphate; the particle size distribution of ammonium bicarbonate is as follows: 50-100 meshes of ammonium carbonate accounts for 30% of the weight of the total pore forming agent, 100-200 meshes of ammonium carbonate accounts for 40% of the weight of the total pore forming agent, and more than 200 meshes of ammonium carbonate accounts for 30% of the weight of the total pore forming agent;

(3) the electrode slurry obtained in step (2) was evenly coated on a titanium mesh with an area of 30 cm×50 cm, and the coating density was controlled to 1.0 kg/$m^2$, and then the coated electrode was pre-dried for 5 hours at a low temperature of 80° C. followed by drying for 5 hours at a high temperature of 110° C.;

(4) the electrode dried in step (3) was put into a mixed solution containing 0.15 mol/L sodium dodecyl benzene sulfonate and a thiophene monomer to be soaked for 2 h, then a 0.1 mol/L $FeCl_3$ solution was added at 5° C. to react for 8 h, wherein a molar ratio of electrode active material to sodium dodecyl benzene sulfonate to ferric trichloride to thiophene monomer was 5:1.5:2:1. After the reaction was ended, the electrode plate was taken out and then washed with water until the washing water was neutral, so as to obtain a conductive thiophene modified porous electrode.

Lithium extraction experiment: a delithiated $Li_{1-x}FePO_4$ electrode was prepared by the method in example 5. An electrolysis device was divided into a cathode chamber and an anode chamber by using an anionic membrane, and the prepared lithium ferric phosphate electrode and the delithiated $Li_{1-x}FePO_4$ electrode were respectively placed into the anode chamber and the cathode chamber. 40 L of to-be-treated brine was injected into the cathode chamber, and 2 L of 5 g/L NaCl solution serving as a support electrolyte was injected into the anode chamber. 0.2 V of voltage was applied to the cathode and the anode to perform electrolysis for 5 hours at 5° C. Components in the brine and the lithium-enriched solution before and after extraction of lithium are seen in Table 9. It can be seen that the concentration of lithium in the brine is reduced from 0.17 g/L to 0.08 g/L; the concentration of lithium in the anode lithium-enriched solution is increased to 1.85 g/L, and a magnesium-to-lithium ratio is reduced from 221.2 in the brine to 0.2 in the lithium-enriched solution. After the electrolysis is ended, the adsorption capacity of the electrode is 24.7 mg (Li)/g ($LiFePO_4$), and the average current density in the above process is 19 A/$m^2$.

TABLE 9

| Concentration (g/L) | Li | Na | Mg | K | $B_2O_3$ | $SO_4^{2-}$ |
|---|---|---|---|---|---|---|
| Brine | 0.17 | 97.40 | 37.60 | 6.34 | 4.3 | 8.47 |
| Brine after extraction of lithium | 0.08 | 97.38 | 37.58 | 6.33 | 4.3 | 8.47 |
| Anode lithium-enriched solution | 1.85 | 2.49 | 0.38 | 0.06 | 0.04 | 0.08 |

Figure 7:
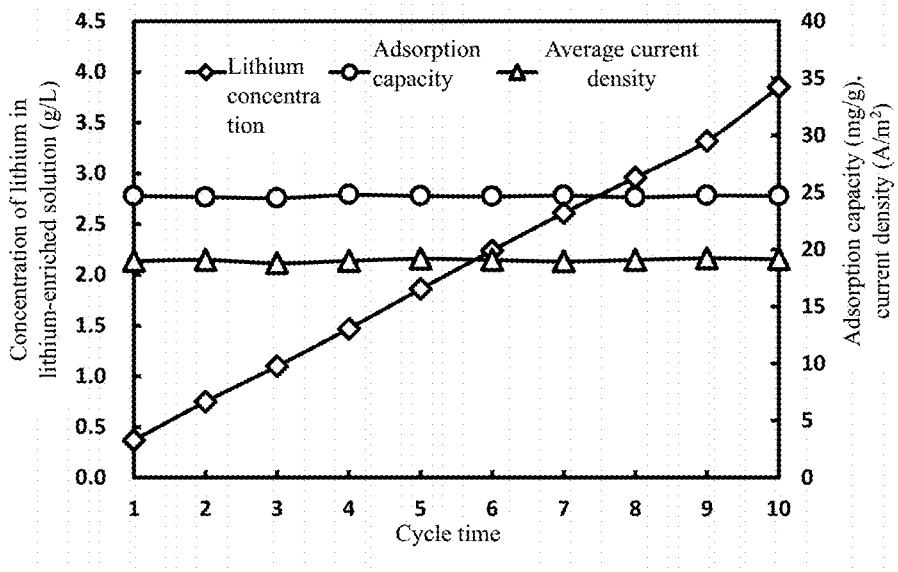
FIG. 7 shows change in concentration of lithium in a lithium-enriched solution with cycle times and cycle performance of an electrode in example 6 of the present disclosure.

After the above extraction of lithium was ended, the cathode and the anode were exchanged, 10 L of 5 g/L NaCl solution serving as a support electrolyte was injected into the anode, 20 L of the above fresh brine was injected into the cathode, and then 0.2 V of voltage was applied to the cathode and the anode to perform electrolysis at 5° C. After each electrolysis period was ended, the cathode and the anode were exchanged, the lithium-containing anode solution in the previous period was continued to serve as an anode solution in the next period, 20 L of fresh brine was changed for the cathode solution each time, and then lithium was extracted under the same conditions. The cycle performance and the lithium enrichment effect of the electrode were investigated. Change in concentrations of lithium in a lithium-enriched solution with cycle times and cycle performance of an electrode in this example are as shown in FIG. 7. It can be seen from FIG. 7 that the lithium ferric phosphate electrode prepared in this example has a good cycle performance, and lithium is enriched in the anode solution during the cycle.

Example 7

Preparation of lithium manganate electrode: (1) zirconium dioxide having a particle size of 80-100 nm, polymethylacrylic acid and PVDF were added into an N-methyl pyrrolidone (NMP) solvent, wherein the addition amount of nano oxides was 2% of the weight of PVDF, the addition amount of polymethylacrylic acid was 15% of the weight of PVDF, then the above materials were mechanically stirred for 5 hours at 40-50° C. to obtain a doped blending modified glue solution;

(2) lithium manganate, acetylene black, carbon nano tubes, short-carbon fibers and a pore forming agent ammonium oxalate were added into the glue solution and then mechanically stirred for 8 hours in vacuum to obtain an electrode slurry, wherein in the slurry, the addition amounts of the PVDF, the acetylene black, the carbon nano tubes, the short-carbon fibers, the pore forming agent and the N-methyl pyrrolidone were successively 15%, 15%, 1.5%, 2.5%, 30% and 190% of the weight of lithium manganate; the particle size distribution of ammonium oxalate is as follows: 50-100 meshes of ammonium oxalate accounts for 25% the weight of the total pore forming agent, 100-200 meshes of ammonium oxalate accounts for 50% the weight of the total pore forming agent, and more than 200 meshes of ammonium oxalate accounts for 25% the weight of the total pore forming agent;

(3) the electrode slurry obtained in step (2) was evenly coated on a carbon fiber cloth with an area of 30 cm×40 cm, and the coating density was controlled to 2.5 kg/m$^2$, and then the coated electrode was pre-dried for 7 hours at a low temperature of 85° C. followed by drying for 8 hours at a high temperature of 120° C.; and (4) the electrode dried in step (3) was put into a mixed solution containing 0.15 mol/L sodium dodecyl benzene sulfonate and a phenylamine monomer to be soaked for 10 h, then a 0.1 mol/L $FeCl_3$ solution was added at 3° C. to react for 10 h, wherein a molar ratio of electrode active material to sodium dodecyl benzene sulfonate to ferric trichloride to phenylamine monomer was 5:2:2:2. After the reaction was ended, the electrode plate was taken out and then washed with water until the washing water was neutral, so as to obtain a polyphenylamine modified porous electrode.

Lithium extraction experiment: a delithiated $Li_{1-x}Mn_2O_4$ electrode was prepared by the method in example 5. An electrolysis device was divided into a cathode chamber and an anode chamber by using an anionic membrane, and the prepared lithium manganate electrode and the delithiated $Li_{1-x}Mn_2O_4$ electrode were respectively placed into the anode chamber and the cathode chamber. 4 L of to-be-treated brine was injected into the cathode chamber, and 1 L of 5 g/L NaCl solution serving as a support electrolyte was injected into the anode chamber. 0.65 V of voltage was applied to the cathode and the anode to perform electrolysis for 4 hours at 15° C. Components in the brine and the anode lithium-enriched solution before and after extraction of lithium are seen in Table 10. It can be seen that the concentration of lithium in the brine is reduced from 1.69 g/L to 0.15 g/L, and the recovery rate of lithium is up to more than 91%; the concentration of lithium in the anode lithium-enriched solution is increased to 6.09 g/L, and a magnesium-to-lithium ratio is reduced from 63.1 in the brine to 0.37 in the lithium-enriched solution. After the electrolysis is ended, the adsorption capacity of the electrode is 20.3 mg (Li)/g ($LiMn_2O_4$), and the average current density in the above process is 48.8 A/m$^2$.

TABLE 10

| Concentration (g/L) | Li | Na | Mg | K | $B_2O_3$ | $SO_4^{2-}$ |
|---|---|---|---|---|---|---|
| Brine | 1.69 | 1.89 | 106.70 | 0.67 | 10.50 | 24.60 |
| Brine after extraction of lithium | 0.15 | 1.88 | 106.05 | 0.66 | 10.44 | 24.47 |
| Anode lithium-enriched solution | 5.34 | 2.04 | 2.24 | 0.02 | 0.22 | 0.44 |

Figure 8:
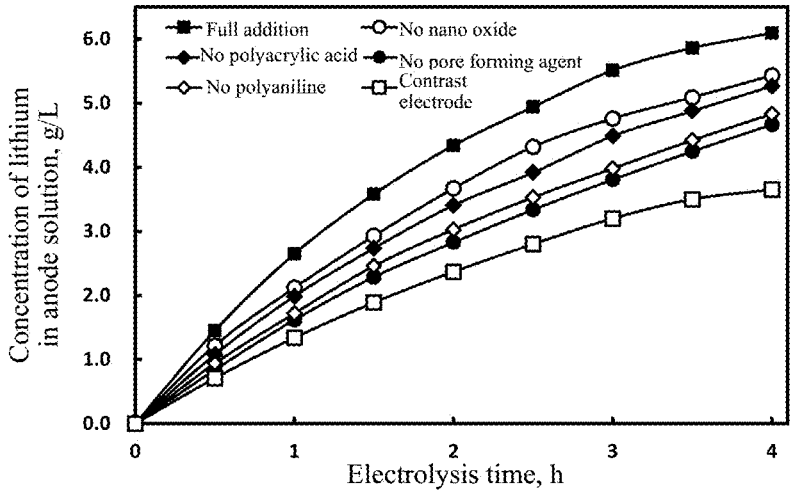
FIG. 8 is a lithium extraction performance comparative graph of electrodes respectively prepared without acrylic acid, polyaniline, nano oxides and pore forming agents under the condition that other preparation process are unchanged and a contrast electrode in example 7 of the present disclosure.

Lithium extraction electrodes were respectively prepared by using the preparation method in example 7 without polyacrylic acid, polyaniline, nano oxides and pore forming agents under the conditions that other preparation process conditions were unchanged, and contrast electrodes were prepared by using a method disclosed in example 1 from Chinese Patent CN107201452B. The coating densities of all the electrodes are 2.5 kg/m$^2$, the to-be-treated brine is the brine with a high magnesium-to-lithium ratio and a concentration of Li being 1.69 g/L, and comparison of lithium extraction effects is as shown in FIG. 8. It can be seen that addition and modification of nano oxides, polyacrylic acid, polyaniline, pore forming agents and the like are conducive to promotion of electrode materials, especially, the electrode obtained by blending, compounding and coating from many aspects have optimal performance.

Figure 9:
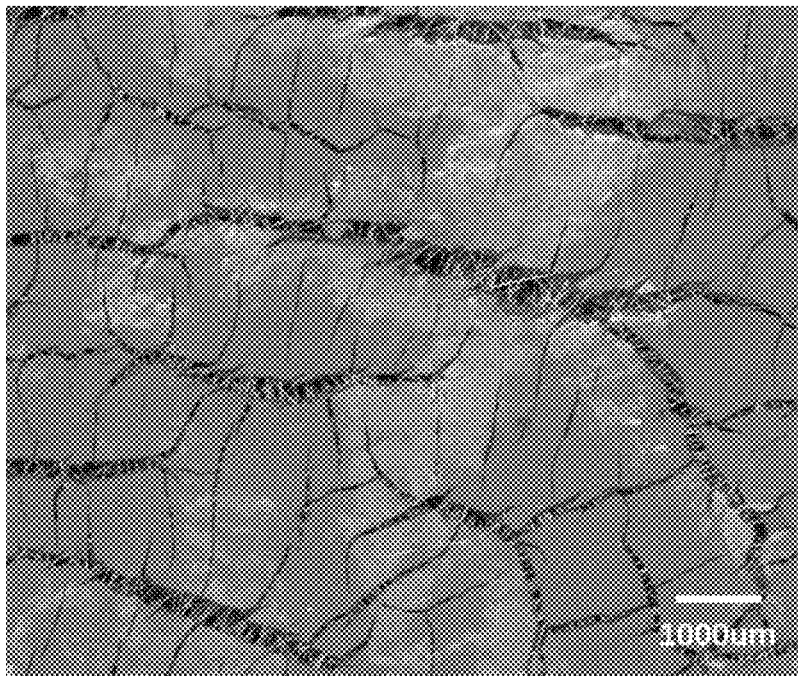
FIG. 9 is a morphology graph of a lithium manganate electrode in example 7 of the present disclosure.
Figure 10:
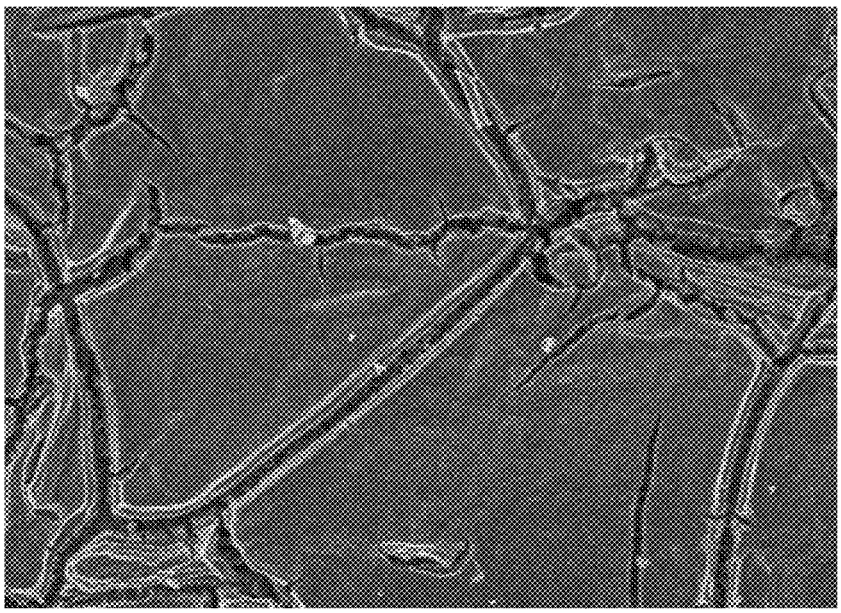
FIG. 10 is a morphology graph of an electrode prepared without short-carbon fibers and a pore forming agent and with other conditions identical to those in example 7.

Under the same magnification times, the morphology of the lithium manganate electrode prepared in this example is as shown in FIG. 9; the morphology of the electrode prepared without short-carbon fibers and a pore forming agent under the conditions that other conditions are unchanged is as shown in FIG. 10. It can be seen that many cracks are present on the surface of the electrode as shown in FIG. 9 and evenly distributed. The cracks of the electrode as shown in FIG. 10 are unevenly distributed, and surface cracking and stripping situations are obviously aggravated. It is indicated that change in preparation processes can directly affect the surface morphology of the electrode and then further influence the lithium extraction performance of the electrode.

Example 8

Preparation of $LiNi_{1/3}Co_{1/3}Mn_{1/3}O_2$ electrode: (1) aluminum oxide having a particle size of 80-100 nm, polymethylacrylic acid and PVDF were added into an N-methyl pyrrolidone (NMP) solvent, wherein the addition amount of nano oxides was 1% of the weight of PVDF, the addition amount of polymethylacrylic acid was 30% of the weight of PVDF, and then the above materials were mechanically stirred for 5 hours in vacuum to obtain a doped blending modified glue solution;

(2) a $LiNi_{1/3}Co_{1/3}Mn_{1/3}O_2$ ternary electrode material, acetylene black, carbon nano tubes, short-carbon fibers and ammonium carbonate were added into the glue solution, and then the above materials were mechanically stirred for 8 hours in vacuum to obtain an electrode slurry, wherein in the slurry, the addition amounts of the PVDF, the acetylene black, the carbon nano tubes, the short-carbon fibers, the pore forming agent and the N-methyl pyrrolidone were successively 8%, 15%, 2%, 1.5%, 40% and 200% of the weight of ternary electrode material; the particle size distribution of ammonium carbonate is as follows: 50-100 meshes of ammonium carbonate accounts for 20% of the weight of the total pore forming agent, 100-200 meshes of ammonium carbonate accounts for 60% of the weight of the total pore forming agent, and more than 200 meshes of ammonium carbonate accounts for 20% of the weight of the total pore forming agent;

(3) the electrode slurry obtained in step (2) was evenly coated on a titanium mesh with an area of 30 cm×40 cm, and the coating density was controlled to 2.0 kg/m$^2$, and then the coated electrode was pre-dried for 5 hours at a low temperature of 80° C. followed by drying for 6 hours at a high temperature of 105° C.;

(4) the electrode dried in step (3) was put into a mixed solution containing 0.15 mol/L sodium dodecyl benzene sulfonate and an indole monomer to be soaked for 6 h, then a 0.1 mol/L $FeCl_3$ solution was added at 0° C. to react for 8 h, wherein a molar ratio of electrode active material to sodium dodecyl benzene sulfonate to ferric trichloride to indole monomer was 5:1:1.5:2. After the reaction was ended, the electrode plate was taken out and then washed with water until the washing water was neutral, so as to obtain a polyindole modified porous electrode.

Lithium extraction experiment: a delithiated $Li_{1-x}Ni_{1/3}Co_{1/3}Mn_{1/3}O_2$ electrode was prepared by the method in example 5. An electrolysis device was divided into a cathode chamber and an anode chamber by using an anionic membrane, and the prepared ternary electrode and the delithiated ternary electrode were respectively placed into the anode chamber and the cathode chamber. 10 L of to-be-treated carbonate brine was injected into the cathode chamber, and 2 L of 5 g/L NaCl solution serving as a support electrolyte was injected into the anode chamber. 0.85 V of voltage was applied to the cathode and the anode to perform electrolysis for 3 hours at 15° C. Components in the brine and the anode lithium-enriched solution before and after extraction of lithium are seen in Table 11. It can be seen that the concentration of lithium in the brine is reduced from 0.67 g/L to 0.15 g/L, and the recovery rate of lithium is up to more than 78%; the concentration of lithium in the anode lithium-enriched solution is increased to 2.63 g/L. After the electrolysis is ended, the adsorption capacity of the electrode is 21.0 mg (Li)/g, and the average current density in the above process is 56.1 A/m$^2$.

TABLE 11

| Concentration (g/L) | Li | Na | K | $CO_3^{2-}$ | $B_2O_3$ | $SO_4^{2-}$ |
|---|---|---|---|---|---|---|
| Brine | 0.67 | 102.80 | 14.90 | 23.40 | 6.30 | 7.50 |
| Brine after extraction of lithium | 0.15 | 102.60 | 14.84 | 23.30 | 6.27 | 7.47 |
| Anode lithium-enriched solution | 2.63 | 3.03 | 0.31 | 0.49 | 0.13 | 0.14 |

Comparative Example 4

Other conditions are the same as those in example 8, and the difference is that the particle size of the pore forming agent ammonium carbonate is 100-200 meshes. After electrolysis for 3.5 hours at 5° C., the concentration of lithium in the brine is reduced from 0.67 g/L to 0.21 g/L, and the recovery rate of lithium is 67.6%. The concentration of lithium in the anode lithium-enriched solution is increased to 2.32 g/L. After the electrolysis is ended, the adsorption capacity of the electrode is 19.3 mg(Li)/g, and the average current density is 42.4 A/m$^2$.

Comparative Example 5

Other conditions are the same as those in example 8, and the difference is that drying is directly performed for 8 hours at a low temperature of 80° C. After electrolysis for 4.2 h, the concentration of lithium in the brine is reduced from 0.67 g/L to 0.23 g/L, and the recovery rate of lithium is 65%. The concentration of lithium in the anode lithium-enriched solution is increased to 2.27 g/L. After the electrolysis is ended, the adsorption capacity of the electrode is 18.9 mg(Li)/g, and the average current density is 34.6 A/m$^2$.

Comparative Example 6

Other conditions are the same as those in example 8, and the difference is that drying is directly performed for 6 hours at a high temperature of 105° C. After electrolysis for 3.7 h, the concentration of lithium in the brine is reduced from 0.67 g/L to 0.23 g/L, and the recovery rate of lithium is 65%. The concentration of lithium in the anode lithium-enriched solution is increased to 2.23 g/L. After the electrolysis is ended, the adsorption capacity of the electrode is 19.4 mg(Li)/g, and the average current density is 40.3 A/m$^2$.

The specific examples of an preparation method of a composite porous electrode material for extracting lithium in the present disclosure are as follows:

Example 9

This example provides a preparation method of a composite porous electrode material for extracting lithium, comprising the following steps:

(1) in a solid-to-liquid mass ratio of 1:5, adding lithium ferric phosphate into a polydopamine solution with a concentration of 0.5 g/L and a pH value of 7.5, stirring and reacting for 20 hours at 40° C., filtering after the reaction, and then drying filter residue at 80° C. to obtain a polydopamine modified lithium ferric phosphate material;

(2) placing a conductive agent acetylene black into 20 wt. % nitric acid to be acidized for 1 hour at 60° C., after that, washing with 0.1 mol/L sodium hydroxide and pure water in sequence, and then filtering to obtain a modified conductive agent;

(3) mixing and pulping the modified conductive agent acetylene black, an aqueous binder polyacrylic acid, a structure reinforcing agent polypropylene fiber, a pore forming agent NaCl and water whose addition amounts are 8%, 15%, 5%, 40% and 300% the weight of the polydopamine modified electrode active material; and (4) coating mixed slurry on carbon fiber cloth, with a coating density of 200 mg$LiFePO_4$/m$^2$ and a coating area of 15×20 cm$^2$, drying for 4 hours at 60° C. and then drying for 5 hours at 120° C., so as to obtain the composite porous electrode material for an aqueous solution system.

Example 10

This example provides a preparation method of a composite porous electrode material for extracting lithium, comprising the following steps:

(1) in a solid-to-liquid ratio of 1:10, adding lithium manganate into a polydopamine solution with a concentration of 5 g/L and a pH value of 10, stirring and reacting for 10 hours at 10° C., filtering after the reaction, and then drying filter residue at 80° C. to obtain a polydopamine modified lithium manganate material;

(2) placing a conductive agent Ketjen black into 65 wt. % nitric acid to be acidized for 12 hours at 20° C., after that, washing with 0.1 mol/L sodium hydroxide and pure water in sequence, and then filtering to obtain a modified conductive agent;

(3) mixing and pulping the modified conductive agent Ketjin black, an aqueous binder polyurethane, a structure reinforcing agent lignin fiber, a pore forming agent $Na_2CO_3$ and water whose addition amounts were 12%, 5%, 0.5%, 20% and 150% of the weight of the polydopamine modified electrode active material; and (4) coating the mixed slurry on a carbon fiber cloth, with a coating density of 150 mg$LiFeMn_2O_4/m^2$ and a coating area of 20×20 $cm^2$, drying for 3 hours at 80° C. and then drying for 6 hours at 100° C., so as to obtain the composite porous electrode material for the aqueous solution system.

Example 11

This example provides a preparation method of a composite porous electrode material for extracting lithium, comprising the following steps:

(1) in a solid-to-liquid ratio of 1:7.5, adding $LiNi_{1/3}Co_{1/3}Mn_{1/3}O_2$ into a polydopamine solution with a concentration of 3 g/L and a pH value of 8, stirring and reacting for 15 hours at 20° C., filtering after the reaction, and then drying filter residue at 80° C. to obtain a polydopamine modified $LiNi_{1/3}Co_{1/3}Mn_{1/3}O_2$ material;

(2) placing a conductive agent superP into 50 wt. % sulfuric acid to be acidized for 10 hours at 30° C., after that, washing with 1 mol/L sodium hydroxide and pure water in sequence, and then filtering to obtain a modified conductive agent;

(3) mixing and pulping the modified conductive agent superP, an aqueous binder polymethyl acrylate, a structure reinforcing agent carbon fiber, a pore forming agent KCl and water whose addition amounts are 10%, 10%, 3%, 30% and 200% the weight of the polydopamine modified electrode active material; and (4) coating the mixed slurry on a carbon fiber cloth, with a coating density of 100 mg/$m^2$ and a coating area of 15×20 $cm^2$, drying for 5 hours at 70° C. and then drying for 6 hours at 90° C., so as to obtain the composite porous electrode material for the aqueous solution system.

Comparative Example 7

This comparative example differs from example 9 in that hydrophilic modification treatment in step (1) of example 9 is not performed on lithium ferric phosphate, and other steps are the same as those in example 9.

Comparative Example 8

This comparative example differs from example 9 in that acidization treatment in step (2) of example 9 is not performed on acetylene black, and other steps are the same as those in example 9.

Comparative Example 9

This comparative example differs from example 9 in that aqueous binder polyacrylic acid in example 9 is changed into hydrophilic PVDF, and others are the same as those in example 9.

Comparative Example 10

This comparative example differs from example 9 in that pore forming treatment in step (3) of example 9 is not performed on lithium ferric phosphate, and others are the same as those in example 9.

Comparative Example 11

This comparative example differs from example 9 in that any modification treatment is not performed on electrodes, a structure of a traditional lithium ion battery is used: $LiFePO_4$+C+PVDF mode, and main steps are as follows:

(1) adding PVDF into NMP (PVDF:NMP=1:15), and stirring to obtain a first mixed homogenate;

(2) successively adding lithium ferric phosphate and acetylene black into the first mixed homogenate ($LiFePO_4$:acetylene black:PVDF:NMP=8:1:1), evenly stirring to obtain a second mixed solution, evenly coating the second mixed solution on a carbon fiber cloth, with a coating density of 200 mg$LiFePO_4/m^2$ and a coating area of 15×20 $cm^2$, and then drying for 24 hours at 70° C. to obtain a finished product electrode.

Experiment Example 1

Preparation of under-lithium lithium ferric phosphate electrode: an electrolytic cell was divided into an anode chamber and a cathode chamber with an anionic membrane, the lithium ferric phosphate electrodes prepared in example 9, comparative example 7, comparative example 8, comparative example 9 and comparative example 10 were respectively used as anodes, foamed nickel was used as a cathode, and the cathode and the anode were both filled with a 15 g/L KCl solution. In addition, for the cathode, the pH of the solution was adjusted to 2-3 with sulfuric acid. 1.0 V of voltage was applied to two ends of the carbon fiber cloth electrode and foamed nickel until the current density was lower than 0.5 A/$m^2$, so as to prepare an under-lithium $Li_{1-x}FePO_4$ electrode.

Lithium extraction experiment: an electrolysis device was divided into a cathode chamber and an anode chamber with an anionic membrane. The lithium ferric phosphate electrode and the under-lithium lithium ferric phosphate electrode were respectively placed into the anode chamber and the cathode chamber. 2.0 L of to-be-treated brine was injected into the cathode chamber. The components of the to-be-treated brine are seen in Table 12. 1.0 L of 10 g/L NaCl solution serving as a support electrolyte was injected into the anode. 0.3 V of voltage was applied to the cathode and the anode to perform electrolysis at 5° C., and the electrolysis was ended when a current was lower than 150 mA. Change in concentration of lithium in the anode obtained by extracting lithium is as shown in FIG. 11, and the cycle performance of the electrode is as shown in FIG. 12.

TABLE 12

| Components of brine | | | | | | |
|---|---|---|---|---|---|---|
| Elements | Li | Na | Mg | K | B | $SO_4^{2-}$ |
| Concentration (g/L) | 1.50 | 88.35 | 12.15 | 20.38 | 2.35 | 19.84 |

Figure 11:
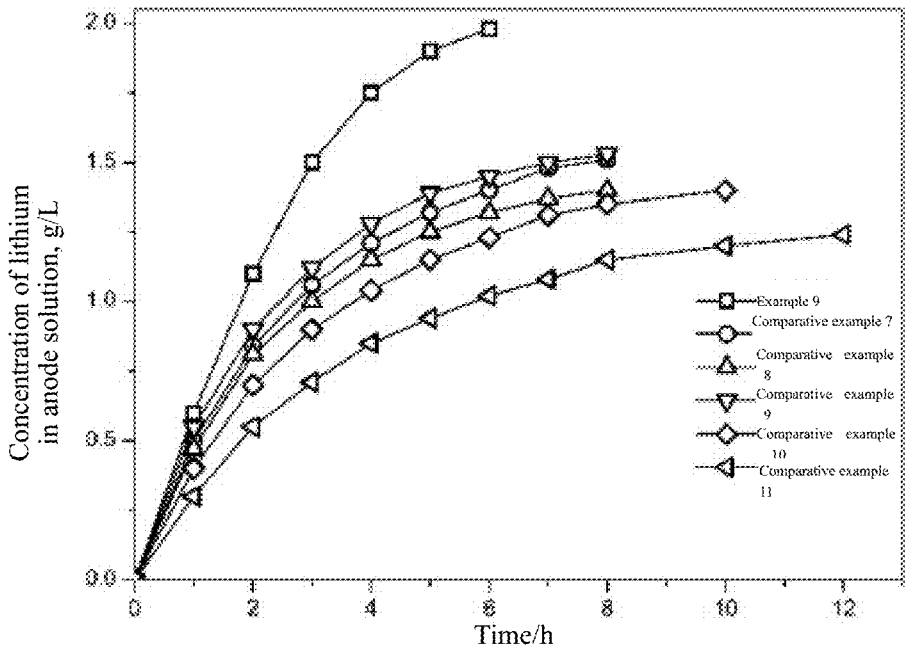
FIG. 11 shows change in concentrations of lithium in an anode solution in the process of extracting lithium from an electrode in example 9 and comparative examples 7-11.
Figure 12:
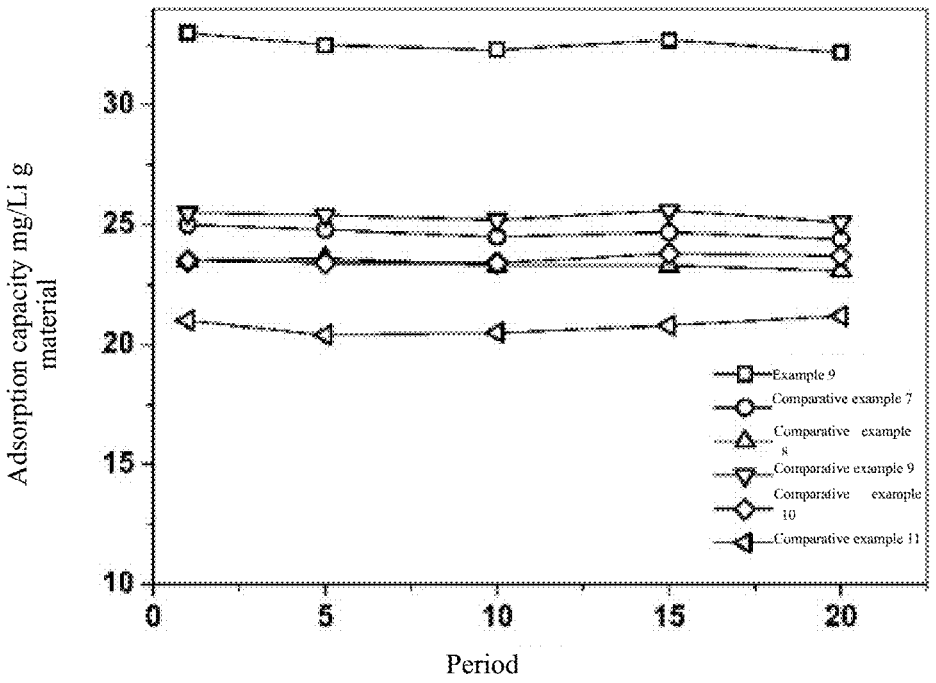
FIG. 12 shows cycle performances of electrodes prepared in example 9 and comparative examples 7-11.

It can be seen from FIG. 11 and FIG. 12 that compared with comparative example 11 in which any modification treatment is not done, all of comparative example 7, comparative example 8, comparative example 9 and comparative example 10 in which modification treatments are done gain certain effects in the aspects of absorption capacity and lithium release rate, however, results obtained in example 9 in which various modification measures are synthesized are not obvious, which is an effect that other single modification measures do not have.

Experiment Example 2

Preparation of under-lithium lithium manganate electrode: an electrolytic cell was divided into an anode chamber and a cathode chamber with an anionic membrane, the lithium manganate electrode prepared in example 10 was used as an anode, foamed nickel was used as a cathode, and the cathode and the anode were both filled with a 20 g/L NaCl solution. In addition, for the cathode, the pH of the solution was adjusted to 2-3 with sulfuric acid. 1.2 V of voltage was applied to two ends of the titanium electrode and foamed nickel until the current density was lower than 0.5 $A/m^2$, so as to prepare an under-lithium $Li_{1-x}Mn_2O_4$ electrode.

Lithium extraction experiment: an electrolysis device was divided into a cathode chamber and an anode chamber with an anionic membrane. The lithium manganate electrode and the under-lithium lithium manganate electrode that were prepared in example 9 and experiment example 2 were respectively placed into the anode chamber and the cathode chamber. 1.0 L of to-be-treated brine was injected into the cathode chamber. The components of the to-be-treated brine are seen in Table 13. 1.0 L of 10 g/L NaCl solution serving as a support electrolyte was injected into the anode. 0.65 V of voltage was applied to the cathode and the anode to perform electrolysis at 10° C., and the electrolysis was ended when a current was lower than 150 mA. Changes in concentration of lithium in the brine in the process of extracting lithium and concentration of lithium in the anode lithium-enriched solution are seen Table 14.

TABLE 13

| Components of brine | | | | | | |
|---|---|---|---|---|---|---|
| Elements | Li | Na | Mg | K | B | $SO_4^{2-}$ |
| Concentration (g/L) | 1.5 | 1.5 | 108.3 | 1.32 | 2.18 | 23.18 |

TABLE 14

| Changes in concentration of lithium in anode and concentration of lithium in brine after extraction of lithium | | | | | | |
|---|---|---|---|---|---|---|
| Elements | Li | Na | Mg | K | B | $SO_4^{2-}$ |
| Initial concentration of brine (g/L) | 1.5 | 1.5 | 108.3 | 1.32 | 2.18 | 23.18 |
| Ending concentration of brine (g/L) | 0.27 | 1.51 | 106.8 | 1.25 | 2.1 | 22.1 |
| Concentration of anode solution (g/L) | 1.25 | 3.95 | 0.73 | 0.08 | 0.05 | 0.23 |

It can be seen from Table 14 that the lithium manganate electrode prepared in example 9 is used, the recovery rate of lithium after electrolysis for 6 hours is up to 82%, a magnesium-to-lithium ratio of the anode lithium-enriched solution is reduced from 72.2 in initial brine to 0.58 in the anode lithium-enriched solution, and this electrode has a good interception effect on impurities such as Na, K, B and $SO_4^{2-}$.

Experiment Example 3

Preparation of under-lithium $Li_{1-x}Ni_{0.33}Co_{0.33}Mn_{0.33}O_2$ electrode: an electrolytic cell was divided into an anode chamber and a cathode chamber with an anionic membrane, the lithium nickel cobalt manganate ternary material electrode prepared in example 11 was used as an anode, foamed nickel was used as a cathode, and the cathode and the anode were both filled with a 10 g/L NaCl solution. In addition, for the cathode, the pH of the solution was adjusted to 2-3 with sulfuric acid. 1.3 V of voltage was applied to two ends of the titanium electrode and the foamed nickel until the current density was lower than 0.5 $A/m^2$, so as to prepare the under-lithium $Li_{1-x}Mn_2O_4$ electrode.

Lithium extraction experiment: an electrolysis device was divided into a cathode chamber and an anode chamber with an anionic membrane. The lithium manganate electrode and the under-lithium lithium manganate electrode that were prepared in example 9 and experiment example 2 were respectively placed into the anode chamber and the cathode chamber. 1.0 L of to-be-treated brine was injected into the cathode chamber. The components of the to-be-treated brine are seen in Table 15. 1.0 L of 10 g/L NaCl solution serving as a support electrolyte was injected into the anode. 0.9 V of voltage was applied to the cathode and the anode to perform electrolysis at 5° C., and the electrolysis was ended when a current was lower than 150 mA. Changes in concentration of lithium in the brine in the process of extracting lithium and concentration of lithium in the anode lithium-enriched solution are seen Table 16.

TABLE 15

| Components of brine | | | | | | |
|---|---|---|---|---|---|---|
| Elements | Li | Na | Mg | K | B | $SO_4^{2-}$ |
| Concentration (g/L) | 0.83 | 90.3 | 0.2 | 20.5 | 1.45 | 21.3 |

TABLE 16

| Changes in concentration of lithium in anode and concentration of lithium in brine after extraction of lithium | | | | | | |
|---|---|---|---|---|---|---|
| Elements | Li | Na | Mg | K | B | $SO_4^{2-}$ |
| Initial concentration of brine (g/L) | 0.83 | 90.3 | 0.2 | 20.5 | 1.45 | 21.3 |
| Ending concentration of brine (g/L) | 0.25 | 88.5 | 0.19 | 20.2 | 1.42 | 21.8 |
| Concentration of anode solution (g/L) | 0.63 | 4.8 | 0.02 | 0.1 | 0.04 | 0.25 |

It can be seen from Table 16 that although 0.83 g/L brine with a high sodium-to-lithium ratio is treated, the material also exhibits a good selective lithium extraction property. After electrolysis is ended, the recovery rate of lithium is as high as 70%, the interception rate of lithium is up to more than 98%, and the interception rates of other impurity ions are also basically maintained at such the level.

The above descriptions are only specific embodiments of the present disclosure, but the protective scope of the present disclosure is not limited thereto. With the technical scope disclosed in the present disclosure, those skilled in the art can easily conceive that variations or replacements are all included within the protective scope of the present disclosure. Therefore, the protective scope of the present disclosure should be based on the protective scope of the appended claims.

What is claimed is:

1. A preparation method of a high-selectivity hydrophilic electrode for extracting lithium, comprising the following steps:

(1) putting an electrode active material into a 0.5-5 g/L polydopamine salt solution in a solid-to-liquid mass ratio of 1:5, adjusting the pH value of the solution to 8-9.5, stirring and reacting for 10-12 hours at room temperature; after the reaction is ended, filtering and washing, and drying filter residues at the temperature of 80-120° C. to obtain a polydopamine modified electrode powder material;

(2) adding a polymer compound and a binder polyvinylidene fluoride (PVDF) into an N-methyl pyrrolidone solvent, mechanically stirring in vacuum until the above materials are completely dissolved, so as to obtain a mixed glue solution;

(3) adding the modified electrode powder material obtained in step (1), a conductive agent acetylene black, a pore forming agent and short-carbon fibers into the mixed glue solution obtained in step (2), and then mechanically stirring for 4-8 hours in vacuum to obtain an electrode slurry, wherein the short-carbon fiber has a particle size of 0.5-3 mm; and (4) coating the electrode slurry obtained in step (3) on a current collector, and then performing segmented drying and water leaching treatment on the coated electrode in turn, so as to obtain a finished product electrode.

2. The preparation method of the high-selectivity hydrophilic electrode for extracting lithium according to claim 1, wherein the electrode active material in step (1) is a lithium ion electrode material selected from the group consisting of one of $LiFePO_4$, $LiMn_2O_4$, $LiNi_xCo_yMn_{(1-x-y)}O_2$ ($0<x, y<1$, $0<x+y<1$) and doped derivatives thereof.

3. The preparation method of the high-selectivity hydrophilic electrode for extracting lithium according to claim 1, wherein the polymer compound in step (2) is a hydroxyl-containing organic matter selected from the group consisting of a mixture of one or more of polyethylene glycol, polyvinyl alcohol, chitosan and polypropylene glycol.

4. The preparation method of the high-selectivity hydrophilic electrode for extracting lithium according to claim 1, wherein the pore forming agent is a mixture of one or more of soluble inorganic salt solids selected from the group consisting of NaCl, KCl, $Na_2SO_4$, $K_2SO_4$, $Na_2CO_3$ and $K_2CO_3$.

5. The preparation method of the high-selectivity hydrophilic electrode for extracting lithium according to claim 1, wherein the particle size distribution of the pore forming agent is as follows: 50-100 meshes of the pore forming agent accounts for 20-30% of the weight of total salts, 100-200 meshes of the pore forming agent accounts for 20-30% of the weight of the total salts, and more than 200 meshes of the pore forming agent accounts for 40-20% of the weight of the total salts.

6. The preparation method of the high-selectivity hydrophilic electrode for extracting lithium according to claim 1, wherein the addition amounts of the polymer compound, the PVDF, the acetylene black, the pore forming agent, the short-carbon fibers and the N-methyl pyrrolidone in the electrode slurry are 0.5-5%, 8-15%, 10-15%, 10-30%, 1-5% and 150-200% of the weight of the electrode powder, respectively.

7. The preparation method of the high-selectivity hydrophilic electrode for extracting lithium according to claim 1, wherein the current collector is selected from the group consisting of a carbon fiber cloth, a carbon fiber felt, a porous carbon-based material, a titanium plate and a titanium mesh.

8. The preparation method of the high-selectivity hydrophilic electrode for extracting lithium according to claim 1, wherein the coating density of the slurry in step (4) is 0.2-5 $kg/m^2$.

9. The preparation method of the high-selectivity hydrophilic electrode for extracting lithium according to claim 1, wherein the segmented drying in step (4) specifically comprises: pre-drying for 3-6 hours at a low temperature of 60-80° C., and then drying for 5-10 hours at a high temperature of 80-120° C.

10. A high-selectivity hydrophilic electrode for extracting lithium prepared by using the method according to claim 1.

* * * * *